US007794371B2

(12) United States Patent
Webber et al.

(10) Patent No.: US 7,794,371 B2
(45) Date of Patent: Sep. 14, 2010

(54) LAT EXERCISE MACHINE WITH SELF-ALIGNING PIVOTING USER SUPPORT

(75) Inventors: Randall T. Webber, La Jolla, CA (US); Bruce Hockridge, San Diego, CA (US); Jeffrey O. Meredith, Del Mar, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 0 days.

(21) Appl. No.: 11/849,028

(22) Filed: Aug. 31, 2007

(65) Prior Publication Data

US 2007/0293377 A1 Dec. 20, 2007

Related U.S. Application Data

(63) Continuation-in-part of application No. 10/633,805, filed on Aug. 4, 2003, now Pat. No. 7,594,880.

(60) Provisional application No. 60/824,572, filed on Sep. 5, 2006.

(51) Int. Cl.
*A63B 21/068* (2006.01)

(52) U.S. Cl. ..... 482/95; 482/96

(58) Field of Classification Search ..... 482/96, 482/72, 71, 95, 112, 51, 140, 130, 90, 57, 482/142, 137
See application file for complete search history.

(56) References Cited

U.S. PATENT DOCUMENTS

| | | | |
|---|---|---|---|
| 248,121 | A | 10/1881 | Tuttle |
| 2,481,121 | A | 10/1881 | Tuttle |
| 2,145,940 | A | 2/1939 | Marlowe |
| 2,252,156 | A | 8/1941 | Bell |
| 3,446,503 | A | 5/1969 | Lawton |
| 3,592,465 | A | 7/1971 | Fulkerson, Jr. |
| 3,640,528 | A | 2/1972 | Proctor |
| 3,707,285 | A | 12/1972 | Martin |
| 4,004,801 | A | 1/1977 | Campanaro et al. |
| 4,111,414 | A | 9/1978 | Roberts |
| 4,231,568 | A | 11/1980 | Riley et al. |
| 4,300,760 | A | 11/1981 | Bobroff |
| 4,441,708 | A | 4/1984 | Brentham |
| 4,632,390 | A | 12/1986 | Richey |

(Continued)

FOREIGN PATENT DOCUMENTS

| | | |
|---|---|---|
| CA | 2075331 | 2/1994 |

OTHER PUBLICATIONS

U.S. Appl. No. 11/846,437, filed Aug. 2007, Webber, et al.

(Continued)

*Primary Examiner*—Jerome Donnelly
(74) *Attorney, Agent, or Firm*—Procopio, Cory, Hargreaves & Savitch LLP

(57) ABSTRACT

A lat exercise machine has a self-aligning pivoting seat or user support on a main frame and an exercise arm for performing lat pulldown or lat row exercises which is linked to the pivoting user support to translate movement of the exercise arm into movement of the user support. A four-bar linkage pivoting mechanism which pivotally connects the user support to the main frame is designed to automatically align in order to maintain proper positioning of the user throughout the exercise motion.

24 Claims, 36 Drawing Sheets

U.S. PATENT DOCUMENTS 4,641,833 A 2/1987 Trethewey
4,700,946 A 10/1987 Breunig
4,743,010 A 5/1988 Geraci
4,793,608 A 12/1988 Mahnke et al.
4,822,038 A 4/1989 Maag
4,844,456 A 7/1989 Habing et al.
4,911,438 A 3/1990 Van Straaten
4,944,641 A 7/1990 Alves
4,949,951 A 8/1990 Deola
4,949,958 A 8/1990 Richey
5,011,139 A 4/1991 Towley
5,050,873 A 9/1991 Jones
5,100,128 A 3/1992 Mabry
5,106,081 A 4/1992 Webb
5,108,095 A 4/1992 Nichols
5,250,013 A 10/1993 Brangi
5,263,914 A 11/1993 Simonson et al.
5,267,930 A 12/1993 Henes
5,299,997 A 4/1994 Chen
5,322,489 A 6/1994 Webb
5,330,404 A 7/1994 Lopeteguy et al.
5,330,405 A 7/1994 Habing et al.
5,334,120 A 8/1994 Rasmussen
5,342,269 A 8/1994 Huang et al.
5,342,270 A 8/1994 Jones
5,346,447 A 9/1994 Stearns
5,352,171 A 10/1994 Lin
5,354,248 A 10/1994 Rawls et al.
5,356,357 A 10/1994 Wang et al.
5,356,358 A * 10/1994 Chen ..... 482/96
D357,041 S 4/1995 McBride et al.
5,417,634 A 5/1995 Habing
5,421,796 A 6/1995 Jones et al.
5,437,589 A 8/1995 Habing
5,447,480 A 9/1995 Fulks
5,453,066 A 9/1995 Richter, Jr.
5,458,553 A 10/1995 Wu
5,478,298 A 12/1995 Chen
5,499,959 A 3/1996 Holmes et al.
5,503,608 A 4/1996 Chang
5,507,710 A 4/1996 Chen
5,520,599 A 5/1996 Chen
5,527,243 A 6/1996 Chen
5,527,249 A 6/1996 Harris
5,527,250 A 6/1996 Chen
5,533,953 A * 7/1996 Lui et al. ..... 482/96
5,540,639 A 7/1996 Potts et al.
D372,509 S 8/1996 Yang
5,547,444 A 8/1996 Huang et al.
5,549,530 A 8/1996 Fulks
5,554,086 A 9/1996 Habing et al.
5,562,577 A 10/1996 Nichols et al.
5,573,482 A 11/1996 Wang et al.
5,580,340 A * 12/1996 Yu ..... 482/96
5,580,341 A 12/1996 Simonson
5,582,563 A 12/1996 Fan
5,597,375 A 1/1997 Simonson
5,603,678 A 2/1997 Wilson
5,616,105 A 4/1997 Wang et al.
5,626,542 A 5/1997 Dalebout et al.
5,643,147 A 7/1997 Huang
5,643,152 A 7/1997 Simonson
5,658,227 A 8/1997 Stearns
5,669,865 A 9/1997 Gordon
5,672,142 A 9/1997 Wu
5,674,161 A 10/1997 Lin
5,676,626 A 10/1997 Huang
5,683,334 A 11/1997 Webber
5,690,593 A 11/1997 Huang
5,695,434 A 12/1997 Dalebout et al.
5,702,328 A 12/1997 Mansvelt
5,720,695 A 2/1998 Eckmann
5,722,918 A 3/1998 Lee
5,733,229 A 3/1998 Dalebout et al.
5,733,232 A 3/1998 Hsu
5,749,813 A 5/1998 Domzalski
5,803,882 A 9/1998 Habing et al.
5,810,698 A 9/1998 Hullett et al.
5,810,701 A 9/1998 Ellis et al.
5,827,158 A 10/1998 Drecksel
5,876,095 A 3/1999 Johnston
5,897,467 A 4/1999 Habing et al.
5,899,836 A * 5/1999 Chen ..... 482/92
5,906,564 A 5/1999 Jacobsen
5,938,570 A 8/1999 Maresh
5,938,571 A 8/1999 Stevens
5,944,641 A 8/1999 Habing
5,961,427 A 10/1999 Habing et al.
5,967,954 A 10/1999 Habing
5,971,901 A 10/1999 Shaw
5,989,165 A 11/1999 Giannelli et al.
5,997,446 A 12/1999 Stearns
5,997,447 A 12/1999 Giannelli et al.
6,004,247 A 12/1999 Webber
6,024,677 A 2/2000 Siwertz
6,071,216 A 6/2000 Giannelli et al.
6,074,328 A 6/2000 Johnson
6,080,091 A 6/2000 Habing et al.
6,086,521 A 7/2000 Solland
6,135,930 A 10/2000 Kuo
6,142,914 A 11/2000 Crawford et al.
6,142,917 A 11/2000 Giannelli et al.
6,152,864 A 11/2000 Giannelli et al.
6,162,153 A 12/2000 Perez et al.
6,244,995 B1 6/2001 Prsala
6,251,047 B1 6/2001 Stearns et al.
6,264,588 B1 7/2001 Ellis
6,302,832 B1 10/2001 Stearns
6,312,366 B1 * 11/2001 Prusick ..... 482/130
6,387,020 B1 5/2002 Simonson
6,394,937 B1 5/2002 Voris
6,491,609 B2 12/2002 Webber
6,579,213 B1 6/2003 Webber et al.
6,605,024 B2 8/2003 Stearns
6,676,577 B2 1/2004 Stearns
6,752,748 B1 6/2004 Scotti
6,811,522 B1 11/2004 McQuinn
6,855,098 B2 2/2005 Reitz et al.
6,913,565 B2 7/2005 Mitchell et al.
6,916,278 B2 7/2005 Webber
6,966,872 B2 11/2005 Eschenbach
6,971,978 B2 12/2005 Hyder
7,052,444 B2 5/2006 Webber
7,070,545 B2 7/2006 Lull et al.
7,108,641 B2 9/2006 Pertegaz-Esteban
7,141,003 B2 11/2006 Wu
7,141,008 B2 11/2006 Krull et al.
7,220,221 B2 5/2007 Mosimann et al.
7,223,213 B2 5/2007 Golesh
7,229,389 B2 6/2007 Hong
7,322,906 B2 1/2008 Webber
7,357,768 B2 4/2008 Marshall
7,361,125 B2 4/2008 Webber et al.
7,384,381 B2 6/2008 Webber et al.
7,468,024 B2 12/2008 Webber et al.
2002/0013199 A1 1/2002 Giannelli et al.
2002/0103058 A1 8/2002 Webber
2002/0187879 A1 12/2002 Ball et al.
2003/0199362 A1 10/2003 Chamberlin
2004/0005966 A1 1/2004 Chen
2005/0032611 A1 2/2005 Webber et al.
2005/0096196 A1 5/2005 Webber et al.
2005/0096197 A1 5/2005 Webber et al.
2005/0096198 A1 5/2005 Webber et al.

| | | | |
|---|---|---|---|
| 2006/0211549 | A1 | 9/2006 | Nohejl |
| 2006/0247107 | A1 | 11/2006 | Carter |
| 2006/0276313 | A1 | 12/2006 | Hong |
| 2007/0232462 | A1 | 10/2007 | Webber et al. |
| 2007/0293377 | A1 | 12/2007 | Webber et al. |
| 2007/0293378 | A1 | 12/2007 | Webber et al. |
| 2008/0058176 | A1 | 3/2008 | Webber et al. |
| 2008/0132389 | A1 | 6/2008 | Webber et al. |
| 2008/0153677 | A1 | 6/2008 | Webber et al. |
| 2008/0182732 | A1 | 7/2008 | Webber et al. |
| 2008/0214365 | A1 | 9/2008 | Webber et al. |
| 2008/0214367 | A1 | 9/2008 | Webber et al. |
| 2008/0220950 | A1 | 9/2008 | Webber et al. |
| 2008/0234110 | A1 | 9/2008 | Webber et al. |
| 2008/0242517 | A1 | 10/2008 | Webber et al. |
| 2008/0248929 | A1 | 10/2008 | Webber et al. |

OTHER PUBLICATIONS

U.S. Appl. No. 11/846,459, filed Aug. 2007, Webber, et al.
U.S. Appl. No. 11/848,012, filed Aug. 2007, Webber, et al.
U.S. Appl. No. 11/846,472, filed Aug. 2007, Webber, et al.
Boss Fitness Brochure, 1993.
Hammer Strength, Hammer Brochure, 1993.
FS-403 Shoulder Press, Flex Brochure, 1995.
Paramount Advanced Performance System—Legg Press AP—2800 (brochure dated 2000).
08003 Rower, Gym 80 Brochure, 2001.
Gym 80 Brochure, 2001.
Leg Press, Cybex International Brochure, 2002.
Flex Fitness Brochure, date unknown.
Pace, 318 Dip/Shrug, Hanley International Brochure, date unknown.
FA-508 Dip Machine, Flex Brochure, date unknown.
Sprint by Hogan Industries, date unknown.
Models 217 and 206-2, Polaris Brochure, date unknown.
Hoist Selectionized Duals HD Series, Hoist Brochure, 2002.
Gravity Gym Instruction Manual, Seated Bench Press, date unknown.
Seated Close Grip Bench Press, Gravity Gym Instruction Manual, date unknown.
Vertical Bench Press Machine, Hoist Brochure, 1993.
Sprint by Hogan Industries, Linear Motion Chest Press, date unknown.
Chest Press and Incline Press, plate-loaded, Cybex Brochure, 1996.
Leg Press Machine, Schwinn Natural Strength, European trade magazine, date unknown.
Low Back Machine, Hoist Brochure, HS1225, 2005.
How It Works Flyer, illustration of exercises performed on U.S. Patent No. 5,527,249 of Harris, date unknown.
Sprint Circuit, Hogan Industries Brochure, date unknown.
S202 Rigid Arm Lat Pulldown, Hoist Customer Catalog, 1995.
Lat Pulldown, Gravity Gym Brochure, date unknown.
Rigid Arm Pulldown, Hoist Fitness Brochure, 2000.
Vertical Tru-Pull, date unknown.
Selectorized Duals, Hoist Fitness Brochure, 2002.
B235 Lat Pulldown, date unknown.
Lat Pulldown, Paramount, date unknown.
Lat Pull, Sprint by Hogan Industries brochure, date unknown.

* cited by examiner

LAT EXERCISE MACHINE WITH SELF-ALIGNING PIVOTING USER SUPPORT

RELATED APPLICATION

The present application claims the benefit of co-pending U.S. provisional patent application No. 60/824,572 filed Sep. 5, 2006, which is incorporated herein by reference in its entirety, and is a Continuation-In-Part of U.S. patent application Ser. No. 10/633,805 filed on Aug. 4, 2003, now U.S. Pat. No. 7,594,880 which is also incorporated herein by reference in its entirety.

BACKGROUND

1. Field of the Invention

This invention relates generally to an exercise machine with a self-aligning pivoting user support, and is particularly concerned with an exercise machine for exercising the lat or latissimus dorsi muscles of the back 2. Related Art The latissimus dorsi or lat muscle is the wing-like muscle of the upper back under each arm. Lat exercise machines are designed to allow a user to perform pulldown or rowing exercises which exercise the lat muscles. In order to perform a lat pulldown exercise, a user grabs an overhead arm and pulls it down against an exercise resistance, in a motion similar to that of a free bar chin up exercise. There are many types of rowing exercise machines. Low row, mid row, leverage row, and T-bar row are the most common strength training versions, and are intended to mimic the upper torso motion of rowing a boat. Both lat pulldown and lat row exercises are compound movement exercises involving more than one muscle group.

Existing pivoting arm pulldown and lat row machines often produce an exaggerated and unnatural arcing movement of the body, which can be uncomfortable for the exerciser.

SUMMARY

In one embodiment, an exercise machine has a pivoting seat or user support on a main frame and an exercise arm for performing lat pulldown or lat row exercises which is linked to the pivoting user support to translate movement of the exercise arm into movement of the user support. A pivoting mechanism which pivotally connects the user support to the main frame is designed to automatically align in order to maintain proper positioning of the user throughout the exercise motion.

In one embodiment, the user support is pivotally mounted on a frame by a four-bar linkage assembly which positions the pivoting action of the linkage below the user, where it does not interfere with a seated user trying to perform the exercise, while the theoretical or combined pivot point of the four-bar linkage is located above the user support. This produces a desirable natural exercise motion which cannot be achieved with a single pivot which would have to be located in the path of the exerciser to reproduce the theoretical pivot point of the four-bar linkage. The exercise machine in this embodiment may be an upper back or lat exercise machine, or may be designed to perform other exercises such as chest press, shoulder press, leg exercises, arm exercises, abdominal exercises or the like.

The user support is linked to the exercise arm so that movement in the arm forces the self-aligning movement in the user support, which is continuous throughout the exercise range of motion. By linking the movement of the user support to that of the exercise arm, this design provides the user with a more comfortable exercise movement that mimics the natural alignment in both the starting and finishing positions when performing a free-bar chin up or rowing a boat. By forcing the user support to move, the exercise machine compensates for the exaggerated and unnatural arcing movement found in some current pivoting arm pulldown and lat row machines and replaces it with the smaller, natural arc an exerciser would go through when performing a chin up or rowing a boat.

In this machine, the user engagement means travels separately from the user support, but movement of the user support is dependent on and linked to the movement of the user engagement means. Movement of the user engagement means may be rotational or may be in a linear exercise path, as described in pending U.S. patent application Ser. Nos. 10/633,805 entitled "Self-Aligning Pivoting Seat Exercise Machine" which was filed on Aug. 4, 2003 and 10/699,995 entitled "Rigid Arm Pulldown Exercise Machine" which was filed on Nov. 3, 2003, the contents of both of which are incorporated herein by reference.

In one embodiment, the user support has a primary support or seat and at least one secondary user support for supporting another part of the user's body, such as the back or feet. The secondary support and seat are in fixed alignment to each other and travel together through the same range of motion and rotate together about the same pivot point, which may be a theoretical pivot point when the user support is pivoted via a four-bar linkage system. In alternative embodiments, a secondary support may be mounted on a connecting link between the exercise arm and user support or user pivot support, or may be a stationary support on the main frame.

An exercise machine in another embodiment has a frame with a base on which a user support and user engagement device or exercise arm is mounted for performing an exercise, and a weight stack housing containing a weight stack for providing selected resistance to an exercise movement. The weight stack housing is selectively mountable either on the left hand side or the right hand side of the user support, based on user preference or on space constraints. This can allow several machines to be mounted closer together by alternating the side on which the weight stack is mounted, for example.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 1B:
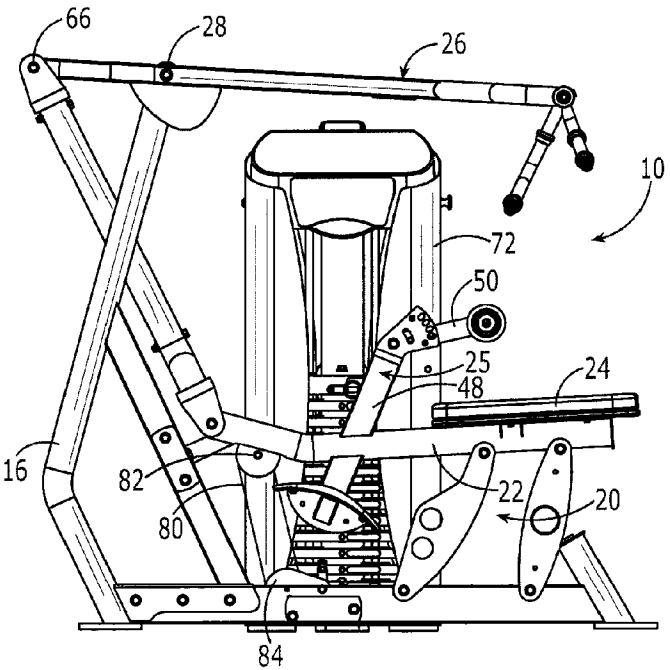
FIG. 1B is a side elevation view of the machine of FIG. 1A in a possible end position for the exercise.

Certain embodiments as disclosed herein provide for lat exercise machines with a self-aligning pivoting seat or user support, designed for performing lat pull down or lat row exercises which exercise the latissimus dorsi ("lat") muscles of the back. Lat exercises are compound exercises which involve more than one body part and multiple joint action. In certain embodiments disclosed herein, a user support is pivotally mounted relative to a main frame via a four bar pivot linkage and is linked to a lat exercise arm for movement with the arm.

After reading this description it will become apparent to one skilled in the art how to implement the invention in various alternative embodiments and alternative applications. However, although various embodiments of the present invention will be described herein, it is understood that these embodiments are presented by way of example only, and not limitation.

FIGS. 1 to 8 illustrate a first embodiment of a rigid arm lat pulldown machine 10 having a pivoting or rocking user support 12. In this embodiment, the user support is mounted via a four-bar pivot which allows the theoretical pivot to be placed in the user support area but has the actual pivoting action take place below the user, as explained in more detail below. In this embodiment, the exercise arm adjusts the position of the user support and aids in placing the user in the proper exercise position at all times so as to substantially replicate the natural upper torso movement of a free-bar Chin Up exercise.

Pulldown exercise machine has a main frame 14 with a horizontal base section 15 and a generally upright section 16. User support 12 is pivotally supported on the frame 14 by a user support pivot system or four-bar pivot linkage 20. User support 12 has a user support frame or base 22, a seat pad 24 mounted at one end of frame 22 providing a primary support for a user, and a thigh hold-down and foot rest device 25 mounted on frame 22 in front of the seat pad to provide secondary user supports. A user engagement device 26 is pivotally connected to the upright section 16 of frame 14 for rotation about a first pivot axis 28, and is linked to the user support frame 22 via connecting link 30 which links movement of the user engagement device to movement of the user support.

Figure 1A:
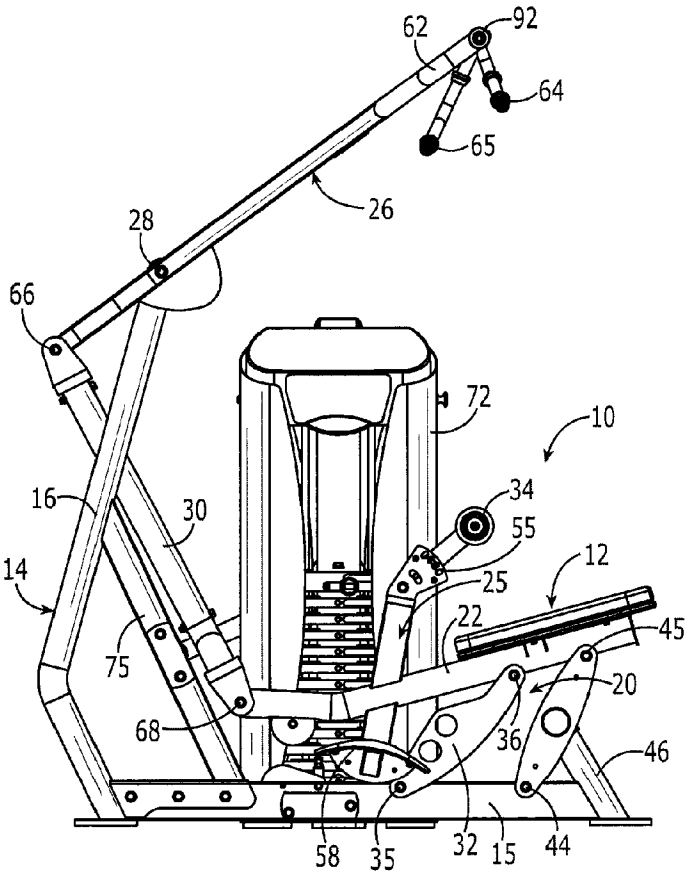
FIG. 1A is a side elevation view of a first embodiment of a lat pulldown exercise machine in a start position.
Figure 2A:
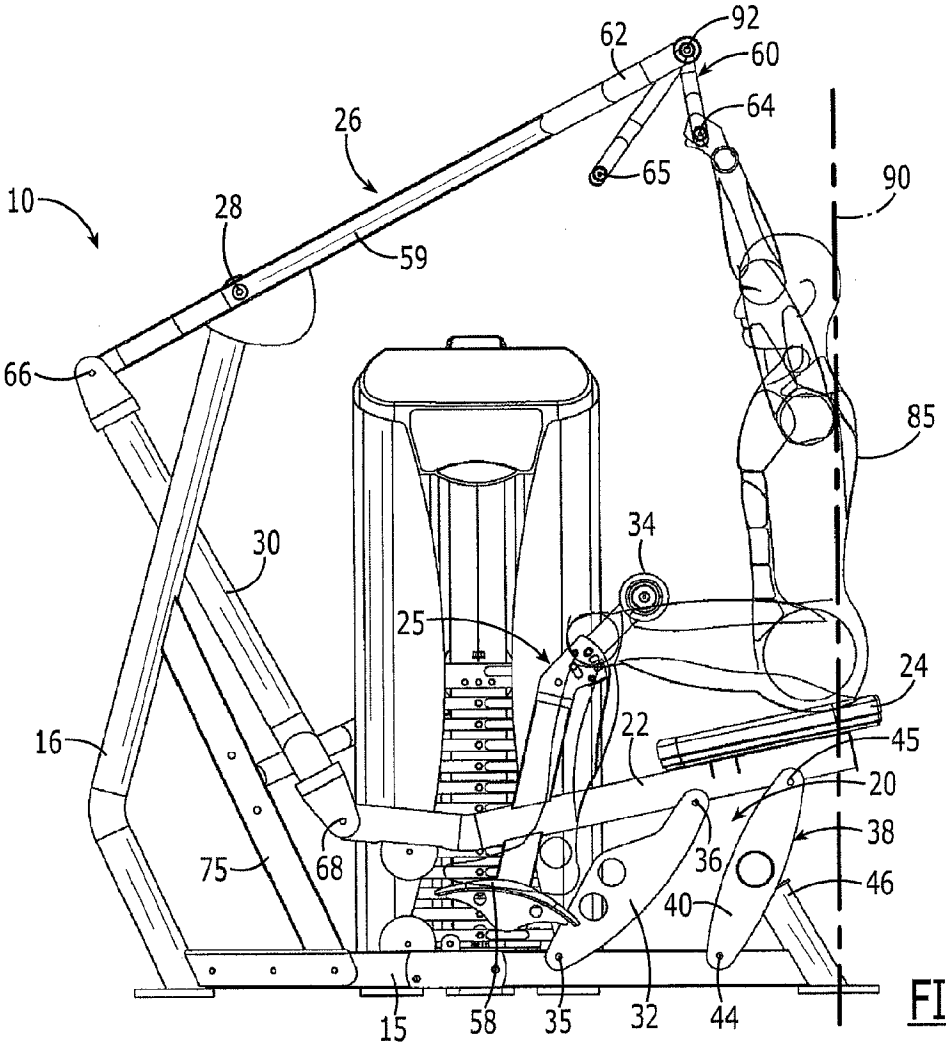
FIGS. 2A and 2B are views similar to FIGS. 1A and 1B but illustrating a seated exerciser performing a lat pulldown exercise on the machine.
Figure 6:
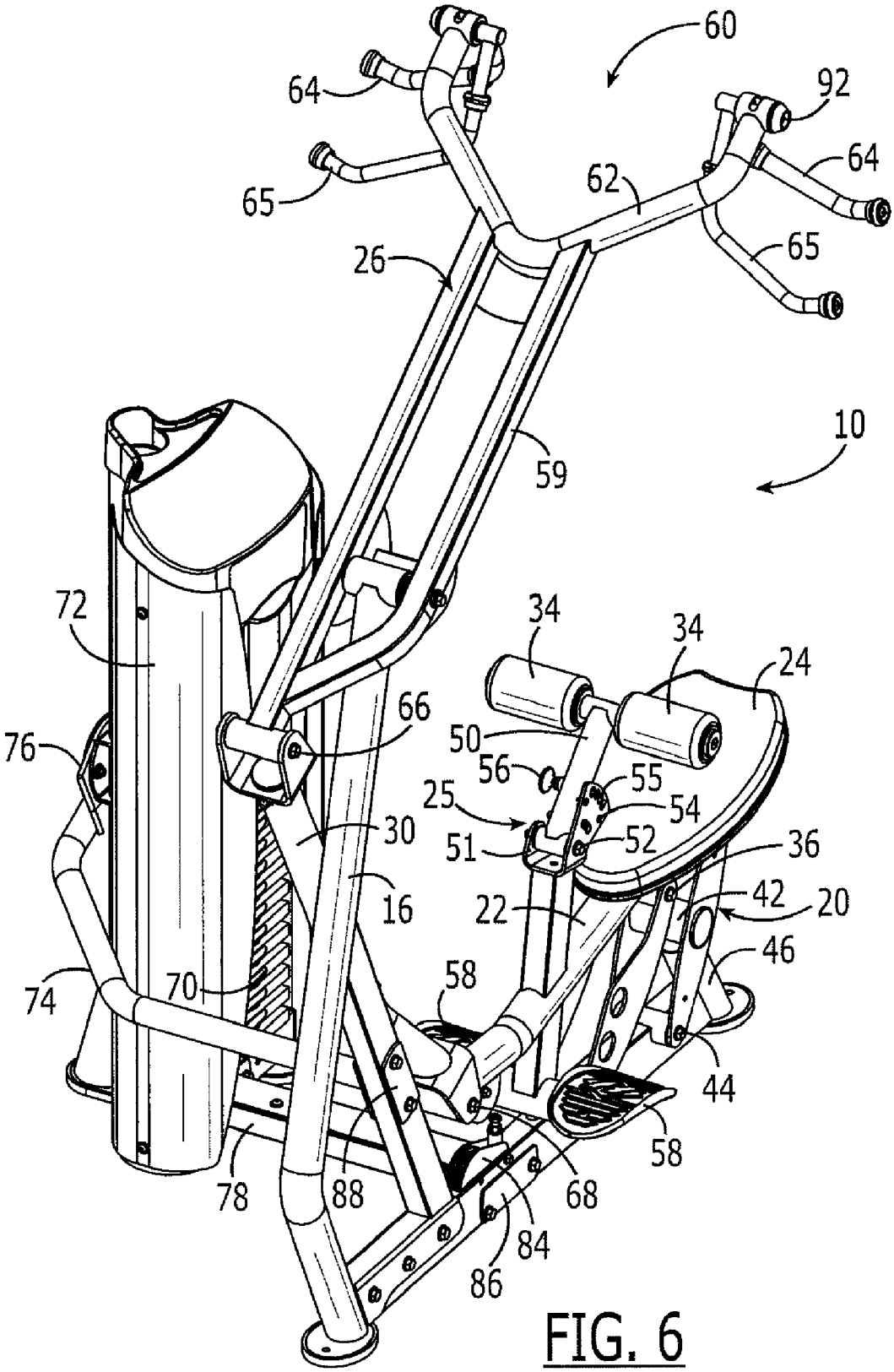
FIG. 6 is a front perspective view of the exercise machine of FIGS. 1 to 5.
Figure 7:
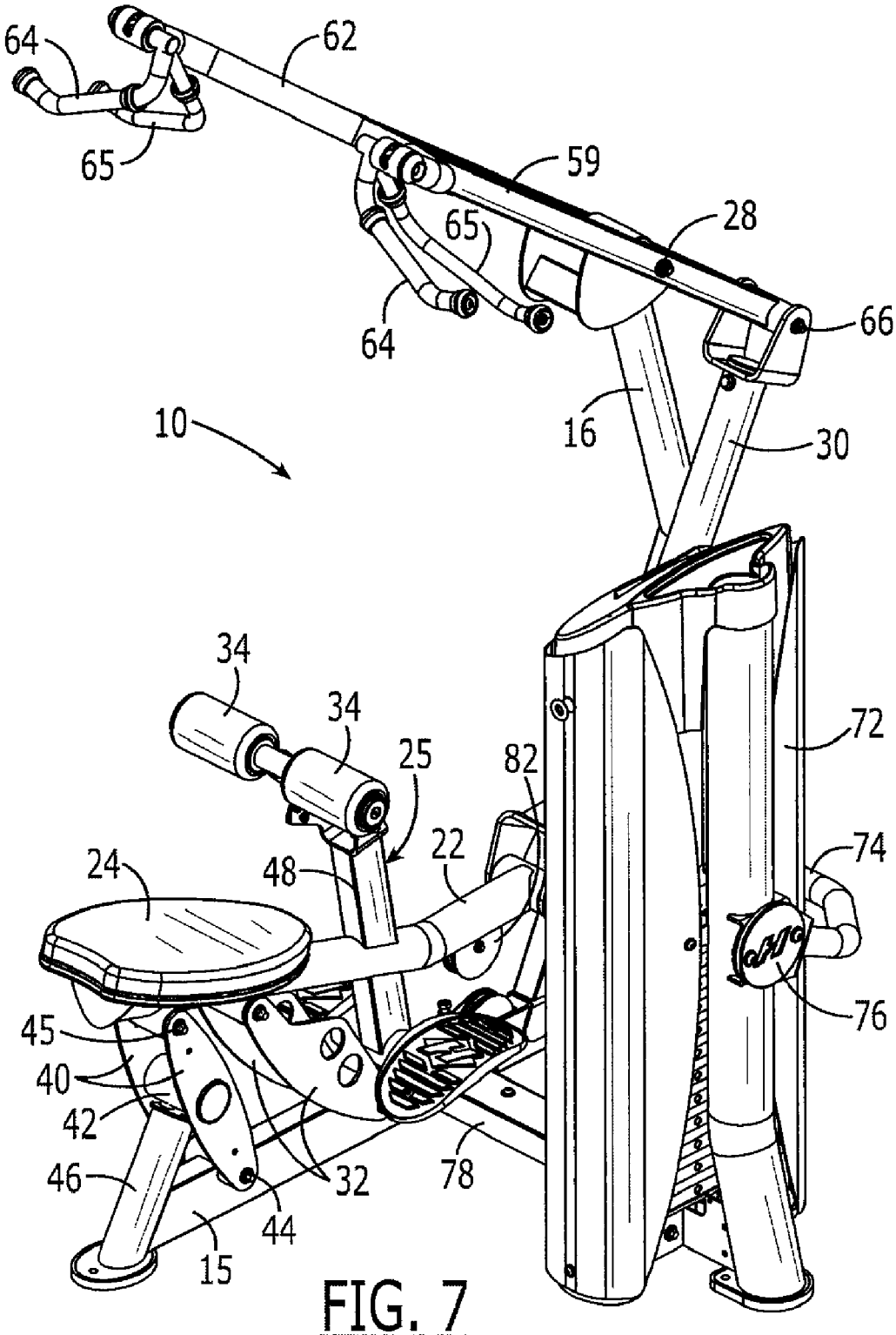
FIG. 7 is a rear perspective view of the exercise machine of FIGS. 1 to 6.

The user support is pivotally mounted to the main frame via the user support pivot system, connected between the base section of the main frame and the user support frame. The pivot system 20 comprises a four-bar linkage which is best illustrated in FIGS. 2, 6 and 7 and which has four spaced, parallel pivot axes. The linkage has a pair of spaced, parallel forward links 32 each pivoted at one end to the base 15 of the frame for rotation about first pivot axis 35 and at the opposite end to the user support frame 22 for rotation about a second pivot axis 36 below a forward end of seat pad 24. A single rear link 38 comprising a pair of plates 40 joined together by connecting shaft 42 is pivoted at one end to the base 15 of the frame for rotation about a third pivot axis 44 spaced rearwardly from axis 35, and pivoted at the opposite end to the user support frame 22 for rotation about a fourth pivot axis 45 spaced rearwardly from axis 36. An upwardly inclined stop or support post 46 at the rear end of the base 15 engages the connecting shaft 42 of rear pivot link 38 to support the user support in a rest or start position of the exercise machine, as illustrated in FIGS. 1A, 2A and 7.

Figure 2B:
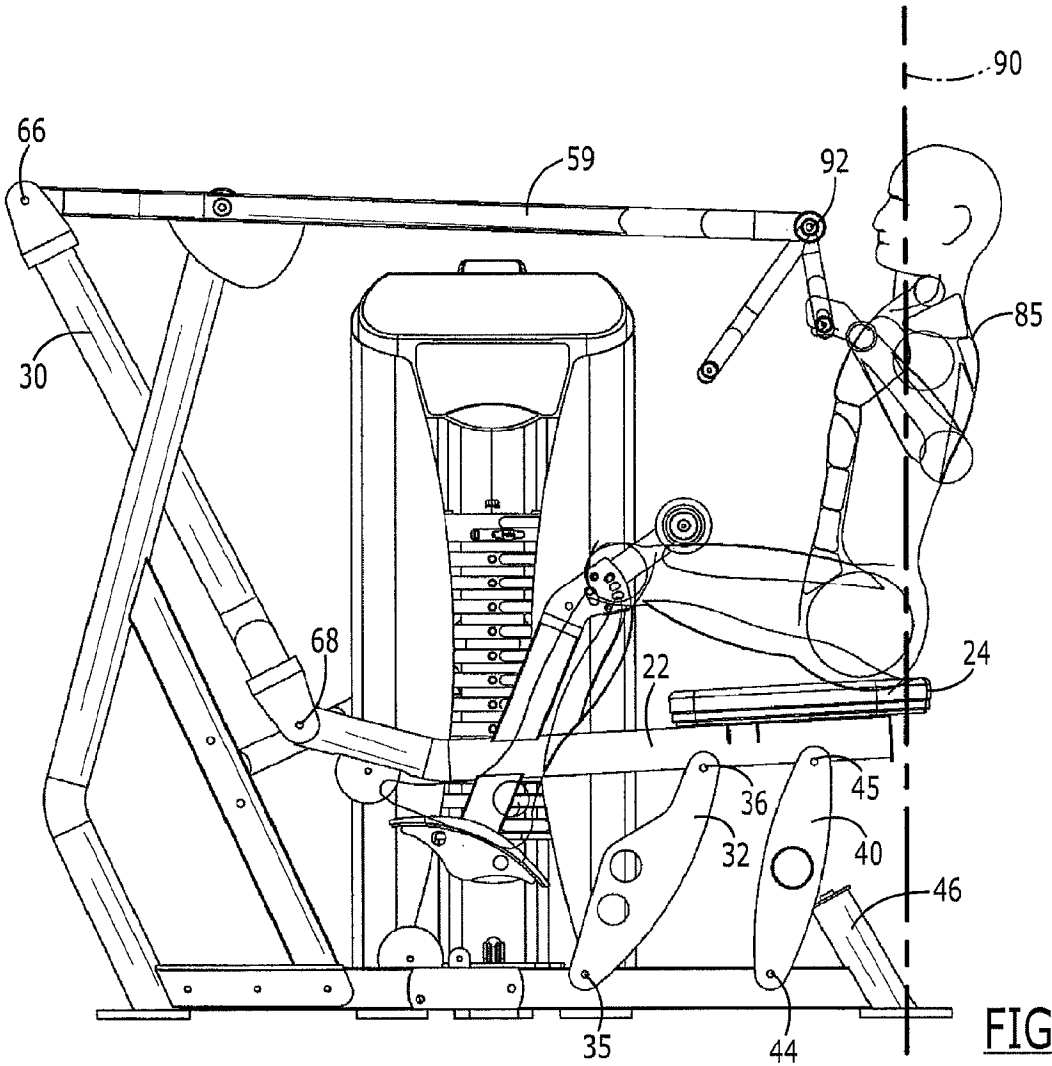
Figure 3:
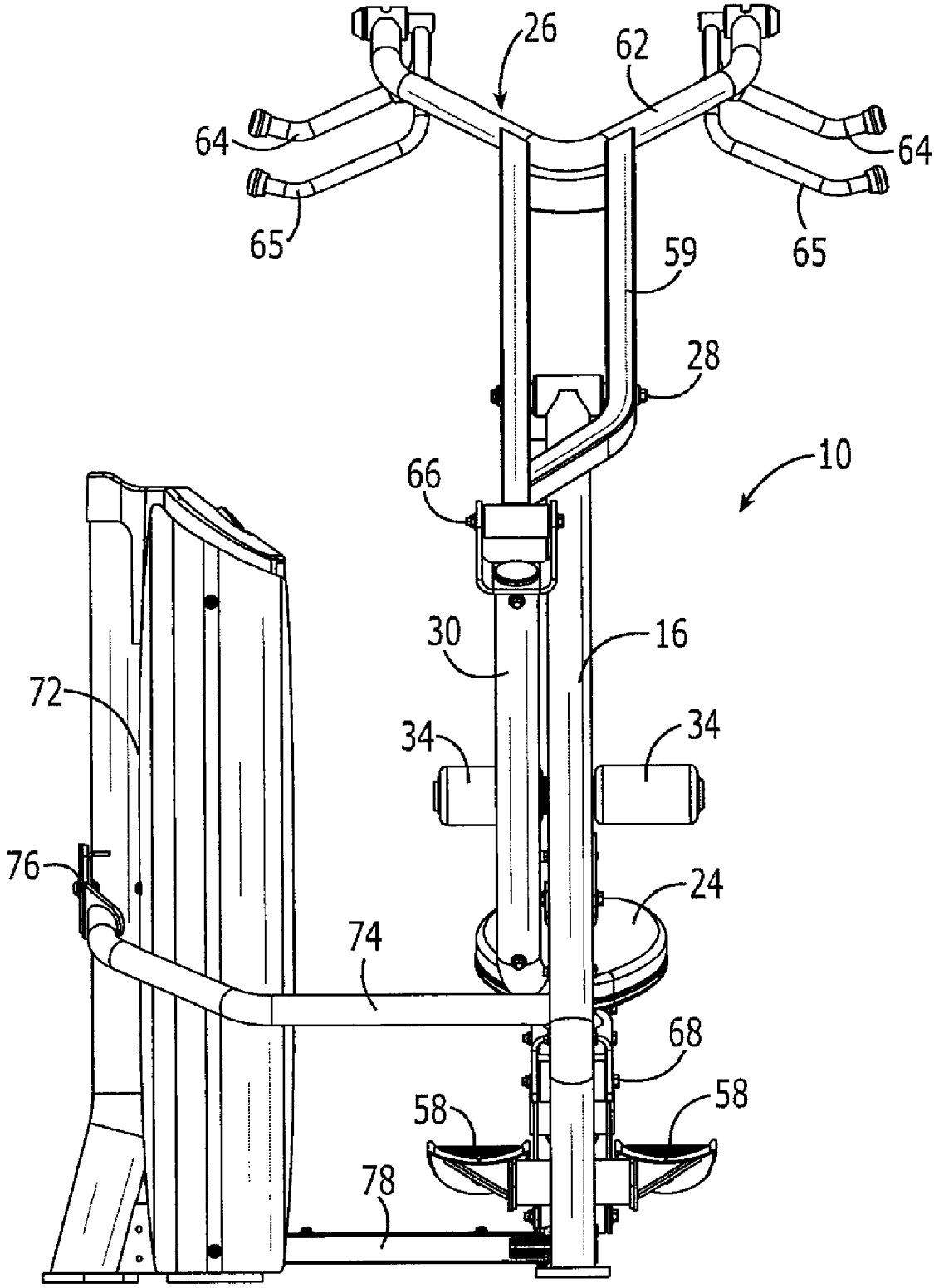
FIG. 3 is a front elevation view of the exercise machine of FIGS. 1 and 2.
Figure 4:
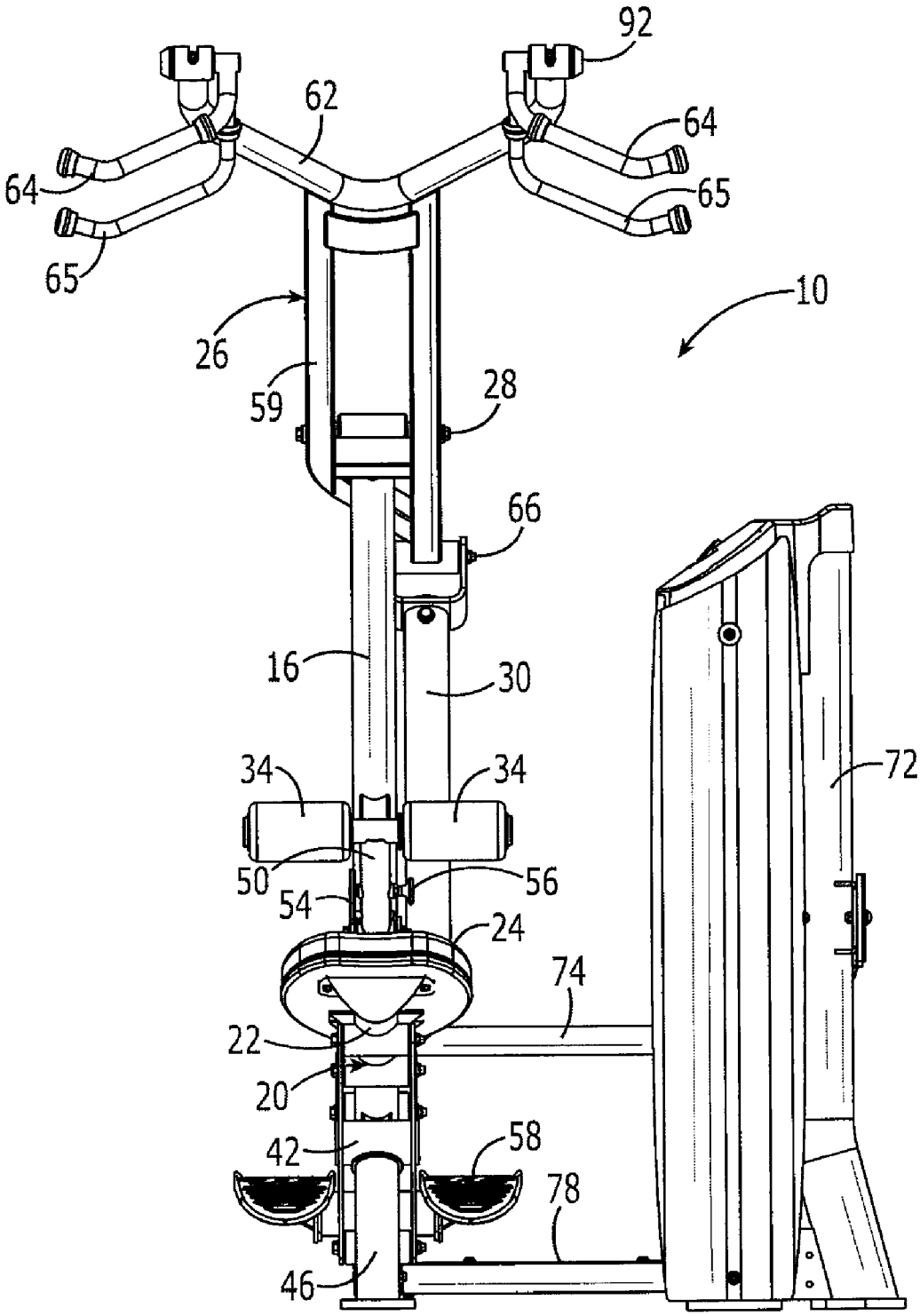
FIG. 4 is a rear elevation view of the exercise machine of FIGS. 1 to 3.
Figure 5:
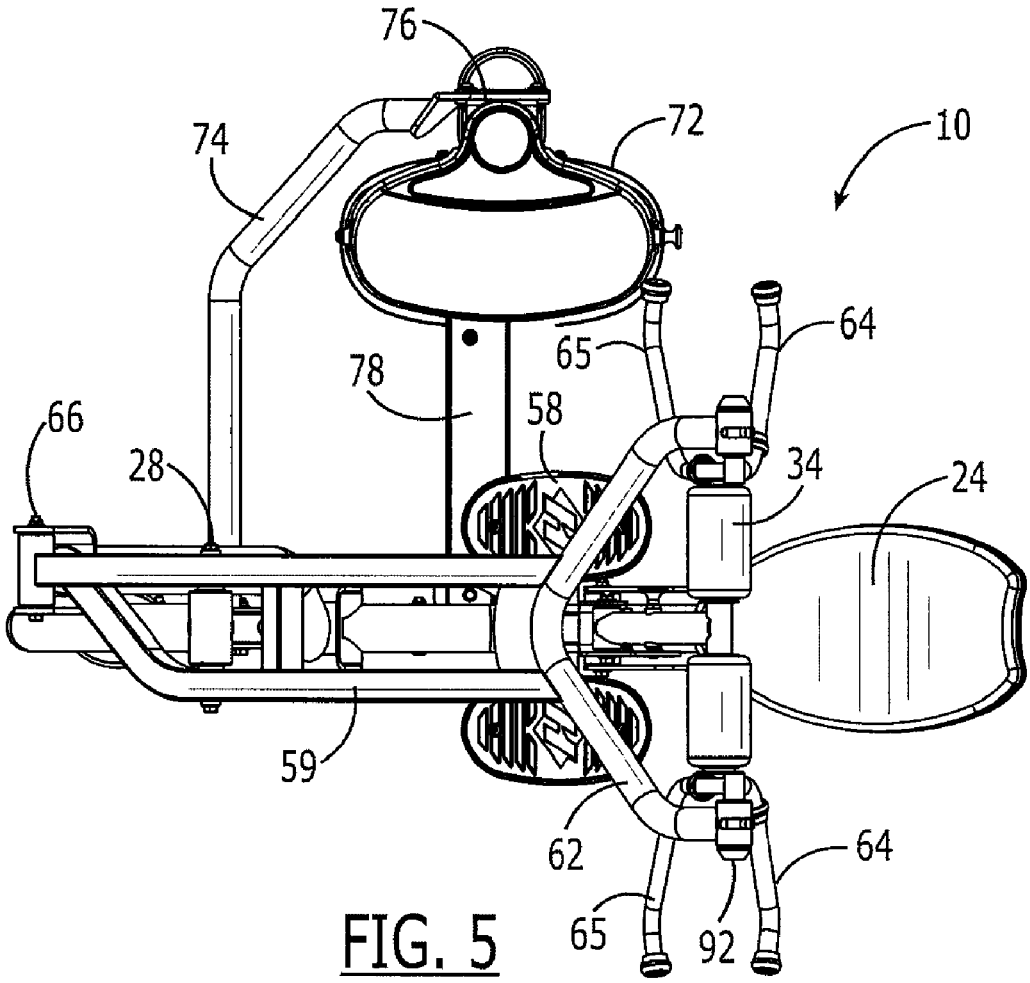
FIG. 5 is a top plan view of the exercise machine of FIGS. 1 to 4.

The seat pad 24 of the user support comprises a primary support for a seated user, as seen in FIGS. 2A and 2B. The thigh hold down and foot rest device 25 comprises a secondary support for a user's feet and thighs. Device 25 has a support post 48 which extends through the user support frame 22 at a location spaced in front of seat pad 24 to form a generally T-shaped junction, as illustrated in FIGS. 6 and 7. A thigh hold down mount 50 has a lower end adjustably mounted at the upper end of post 48 for rotation about pivot axis 52. A pair of thigh hold down pads 34 are rotatably mounted at or adjacent the upper end of the mount 50. The lower end of mount 50 is mounted between opposing end plates of a pivot bracket 51 at the upper end of post 48, and is secured at a selected angle relative to post 48 via a range of motion (ROM) device. The ROM device comprises a plate extension 54 from one side of the pivot bracket 51 having a series of openings 55 extending on an arc and a spring loaded pull pin 56 on mount 50 which engages in a selected opening 55 to secure the thigh hold down mount 50 at a selected orientation. This allows the position of the hold down pads 34 to be adjusted to a comfortable position by the user before an exercise is started. A pair of footrests 58 are mounted at or adjacent the lower end of post 48 below thigh hold down mount and forward of the user support seat 24.

The user engagement device 26 comprises an exercise arm 59 which is pivotally mounted to the upright section of the main frame at an intermediate position in its length for rotation about pivot axis 28, and has a first portion which extends rearward from the pivot axis 28 with a user-engaging handle assembly 60 at the rear end. As best illustrated in FIG. 6, handle assembly 60 comprises a generally U-shaped member or yoke 62 secured to the exercise arm 59 at a central position. A pair of handles or grips 64,65 are pivotally attached to opposite ends of yoke 62 for rotation about pivot axis 92 during an exercise movement.

The connecting link 30 is pivotally attached at its first end to the second or forward end of exercise arm 59 for rotation about pivot axis 66 and to the user support frame 22 at its second end for rotation about pivot axis 68. The connecting link 30 may alternatively be pivotally attached to the user support pivot system at its second end, instead of to the user support frame. In either case, movement in the exercise arm translates into movement in the user support.

Although the user support is linked to the exercise arm in this embodiment by means of a pivoted connecting link, other linkages between the exercise arm and user support or between the exercise arm and user support pivot system 20 may be provided in alternative embodiments. The connecting link could be adjustable in length, as described in U.S. patent application Ser. No. 10/699,995 referenced above, the contents of which are incorporated herein by reference, and may comprise a counterweight to counterbalance the weight of the forward section of the exercise arm, as taught in U.S. Pat. No. 6,491,609, the contents of which are also incorporated herein by reference. The connecting link may be a rigid link as illustrated, or may be a flexible pulley and cable linkage, a sliding linkage, a gear linkage, a rotating cam linkage, or the like, as described in prior U.S. patent application Ser. No. 10/699,995.

Connecting link 30 pivotally connects exercise arm 59 with the user support and converts downward movement of the exercise arm (about its pivotal connection to the main frame) into upward movement of the user support. Because of the location of the connecting link attachment to the exercise arm, downward movement of the handles forces the exercise arm to rotate about its connection to the main frame which pulls the connecting link upward, simultaneously pulling the forward end of the user support upward which in turn forces the user support four-bar pivot system 20 to rotate. This four-bar linkage is designed to control the forward and upward movement of the user support seat and reorient the seat from an inclined to a substantially horizontal position while shifting the seat slightly forward, as described in more detail below.

A cable and pulley system connects the user support 12 with a weight stack 70 to provide resistance to movement by the user support. The weight stack is housed in a vertical weight stack support frame or housing 72 and comprises a stack of weights running on two guide rods. This is commonly known as a selectorized machine. This weight stack is in a side-loaded position to one side of the main frame. The weight stack support frame 72 is secured to the main frame of the machine by a connecting rod or bar 74 having a first end secured on one side of an angled strut 75 extending between the base 15 and upright 16 of the main frame, and a second end secured to a mounting plate 76 on the outer face of frame or housing 72, as best illustrated in FIG. 6. A guide tube 78 for the cable and pulley linkage is secured between the base section 15 of the main frame and the weight stack frame. The cable and pulley linkage has a first cable 80 anchored to the base section 15 and extending around a first pulley 82 on the user support frame 22, a second pulley 84 on the base section 15, and then through the guide tube 78 where it is linked to additional pulleys and cables connected to the upper end of the weight stack in any suitable manner.

The connection between the weight stack and main frame is designed to allow the weight stack to be connected on either side of the main frame. In the drawings, weight stack housing 72 is secured to right hand side of a user 85 seated on the user support facing the forward end of the machine, as illustrated in FIGS. 2A and 2B. The housing 72 may alternatively be positioned on the left hand side of the user. In order to adjust the weight stack position, the connecting rod or bar 74 is unbolted from the strut 75 and the mounting plate 76, and the cable guide tube 78 is unbolted from the base section 15 of the frame. The weight stack housing 72 can then be positioned on the opposite side of the frame with the guide tube 78 secured at the location of plate 86 in FIG. 6, and the cable 80 threaded around pulley 84 from the opposite side. Connecting rod 74 is then secured at its first end to the opposite side of strut 75 at the location of plate 88 in FIG. 6, and secured at its second end to the mounting plate 76 on the outer side of the weight plate housing.

By allowing the weight stack housing to be mounted on either side of the exercise machine, the user or owner of the machine can select which side is best for locating the weight stack, based on user preference or space constraints. If several such machines are to be located in a common area, the weight stack housing on one machine can be on one side and the next machine can have the weight stack housing on the opposite side, so that the machines can be staggered and the weight stacks positioned adjacent one another. This allows machines to be positioned closer together so that they take up less floor space.

FIGS. 2A and 2B show a user 85 on the machine 10 in the start and finish positions respectively, with the dotted line 90 representing the gravitational centerline of the pivotal movement. To perform the exercise the user sits on user support seat 24 and places their feet on the foot rest 58 with their knees under the thigh hold down pads 34, which may be adjusted as necessary using the ROM 54 and releasable pull pin 56. The user then reaches up and grabs the user engaging handles on the exercise arm. This is the position illustrated in FIG. 2A. There are two handle grip positions 64, 65 and the user selects the one best suited for their height, in this case handles 64. They then pull the handles downward towards their chest, stopping when their hands reach shoulder level, as in FIG. 2B.

The user engaging handles 64, 65 in this design are pivotally connected to the ends of member 62 for rotation about aligned pivot axes 92, and self-align to the position of the user's hands during the exercise movement.

In moving from the start position of FIG. 2A to the finish position of FIG. 2B, the seat pad 24 and underlying user support frame or strut 22 moves from an inclined position to a substantially horizontal orientation. The user 85 moves from a forward lean in FIG. 2A to a rearward lean in FIG. 2B, and the user's hands go from extended overhead to shoulder level. A portion of the user and user support is located on each side of the gravitational centerline 90 in both the start and finish positions. As the user support seat moves in one direction, the upper body of the user moves in the opposite direction. Because the user is securely positioned on the traveling user support, only a small adjustment at the hip is needed to duplicate the natural upper body movement/positioning of a free-bar chin up exercise. This combination of forward shift of the user support and rearward lean of the user offset each other with regards to gravitational centerline displacement, so that this movement goes unnoticed as it has no effect on the resistance felt by the user during the exercise. The amount of upper body movement, which depends on the combined travel of the exercise arm and user support, varies slightly with different size users.

As the user pulls the exercise arm downwards about pivot 28, the connecting link 30 is pulled upwards and forward at its lower end, which in turn forces the user support frame 22 to rotate upward and forward about its pivotal connection to the main frame. This combined movement of seat and exercise arm provides a relatively safe and natural feeling exercise motion. It replaces both the improper linear motion and the exaggerated arcing movement found on some current rigid arm lat pulldown machines. By using the four-bar linkage 20 as the user support pivot system, all the pivoting action can take place under the user and does not interfere with the performance of the exercise.

Figure 8:
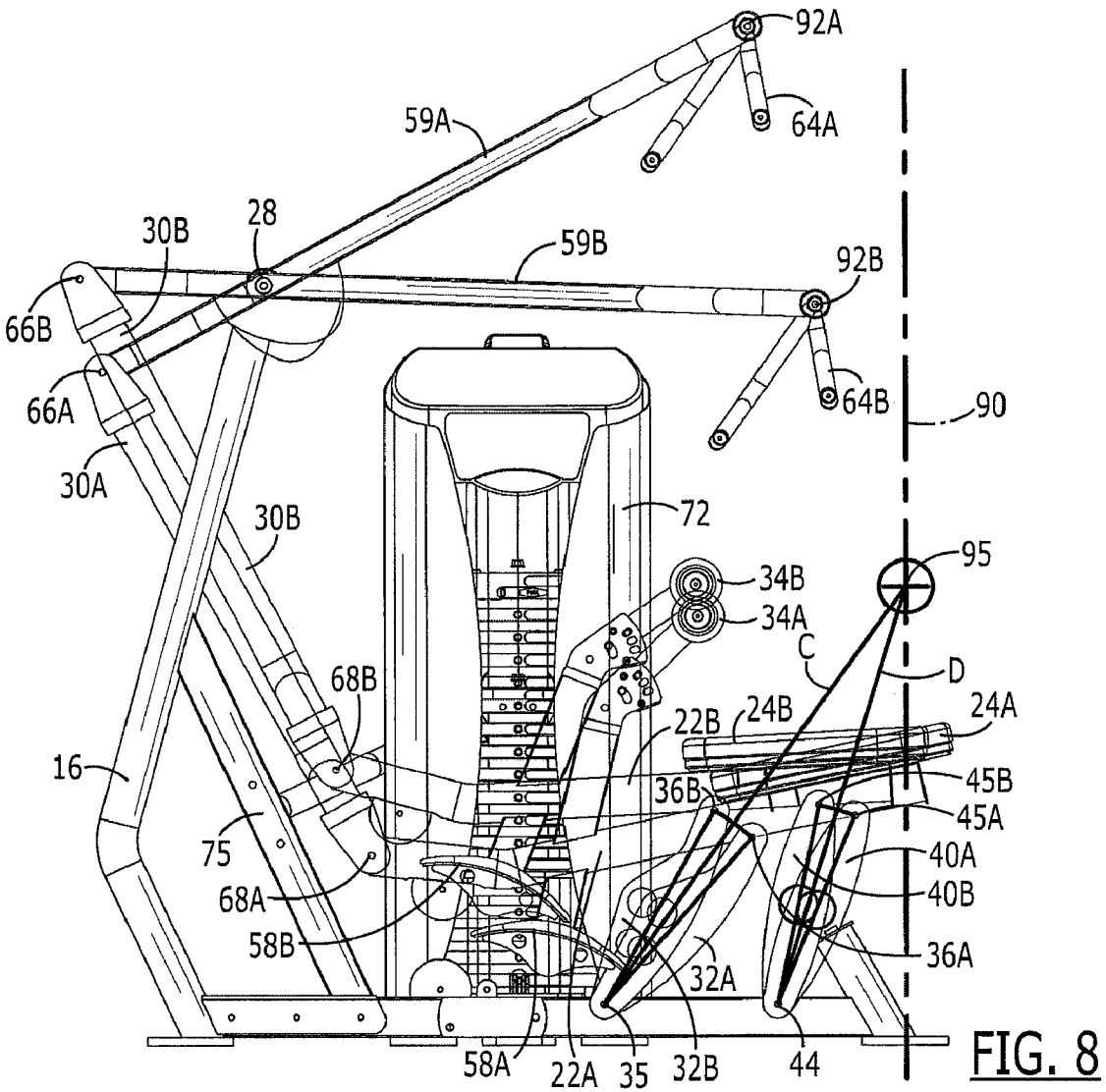
FIG. 8 is a side elevation view of the start and finish positions of the machine of FIGS. 1 to 7 superimposed, illustrating a theoretical pivot point for the four-bar user support pivot system.

While the pivot action is located below the seated user, the theoretical pivot 95 is actually located in the user support area above the user support seat, as illustrated in FIG. 8, and would interfere with a seated user trying to perform the exercise if the four-bar pivot system was replaced by a single pivot. Without the advantage of this four-bar pivot system combined with the connecting link 30, the combined exercise arm and user support movement between the positions illustrated in FIGS. 2A and 2B would not be possible. The location of this theoretical pivot places a portion of user and user support on both sides of the gravitational centerline of pivot 95 throughout the exercise motion. By having a small portion of the user's body weight (as well as the weight of the user support) on the opposite side of the gravitational centerline from the resistance it helps to counter-balance or lessen the initial lift (starting resistance).

In FIG. 8, the start and finish positions of the exercise movement are superimposed in order to illustrate the theoretical pivot location and how different parts of the machine are oriented in the finish position relative to the start position. The parts which move are designated with an A in the start position and a B in the finish position. The two pivots 35 and 44 of the links 32 and 40 to the main frame are fixed, while the pivots 36 and 45 travel from positions 36A and 45A to positions 36B and 45B, respectively. FIG. 8 illustrates the plotting of the theoretical pivot point for the user support. It takes an overlapping composite view of the machine in the start and finish position and calculates the centerline C, D of the arcing movement for each link of the user support pivot system. It then shows the point in space where the two centerlines C, D intersect, forming the theoretical pivot 95 of the user support. From this point we can determine the gravitational centerline 90 which is shown as a dotted vertical line. The first centerline C extends from pivot 35 through the center of a line connecting the start and end position 36A,36B of pivot 36, and the second centerline D extends from pivot 44 through the center of a line connecting the start and end positions 45A,45B of pivot 45. It can be seen from this drawing that without using the four-bar user support pivot system, a single fixed pivot would not work as it would intrude on the user and interfere with the user's ability to perform the exercise. Without the four-bar linkage, this unique movement pattern for the user support would not be possible. It would be impossible to duplicate the pivoting movement of the user support provided by four-bar pivot linkage 20 with a single pivot mount, since this would require an actual pivot at point 95, which would clearly interfere with the user support area and would not allow the user to move freely from the start to the finish position of the exercise.

During the exercise motion, the angle of the user support seat goes from inclined to substantially horizontal because movement in the four-bar pivot system dips the rear end of the user support seat as it raises the front end. It also shifts the pad forward slightly (compare pad positions 24A and 24B in FIG. 8). This combined action moves more of the user support and a lower portion of the user onto the resistance side of the gravitational centerline, as can be seen by comparing FIGS. 2A and 2B. This is done to offset or neutralize the rearward lean of the user as they follow the natural chin up motion and bring the exercise arm handles down past their face, finishing in the upper chest and shoulder area. By providing this forward shift to the user and user support there is no perceived shift in combined weight from one side of the gravitational centerline to the other and no noticeable effect on the exercise resistance felt by the user. Without this forward shift, the user could feel a slight drop-off in resistance at the end of the exercise as their upper torso leans rearward and shifts to the non-resistance side of the gravitational centerline.

In this embodiment, the exercise arm pivot 28 is positioned forward of the user support. As noted above, the starting position of FIG. 2A places the user with their arms extending overhead with a slight forward lean to their upper body. The finish position of FIG. 2B places the user with their hands below their chin, slightly in front of their shoulders and in a slight rearward lean. This replicates the starting and finishing positions of an exerciser performing a chin up on a stationary bar. The user automatically adjusts their upper body position (relative to their angular position on the seat) to compensate for the change in seat angle. This slight rearward movement mimics the natural rearward arc a person's upper body goes through when performing a chin up exercise and is a very slight adjustment (pivoting at the waist) that goes practically unnoticed by the exerciser because they are in a stable, braced position with their thighs supported under the thigh support pads 34.

Figure 9A:
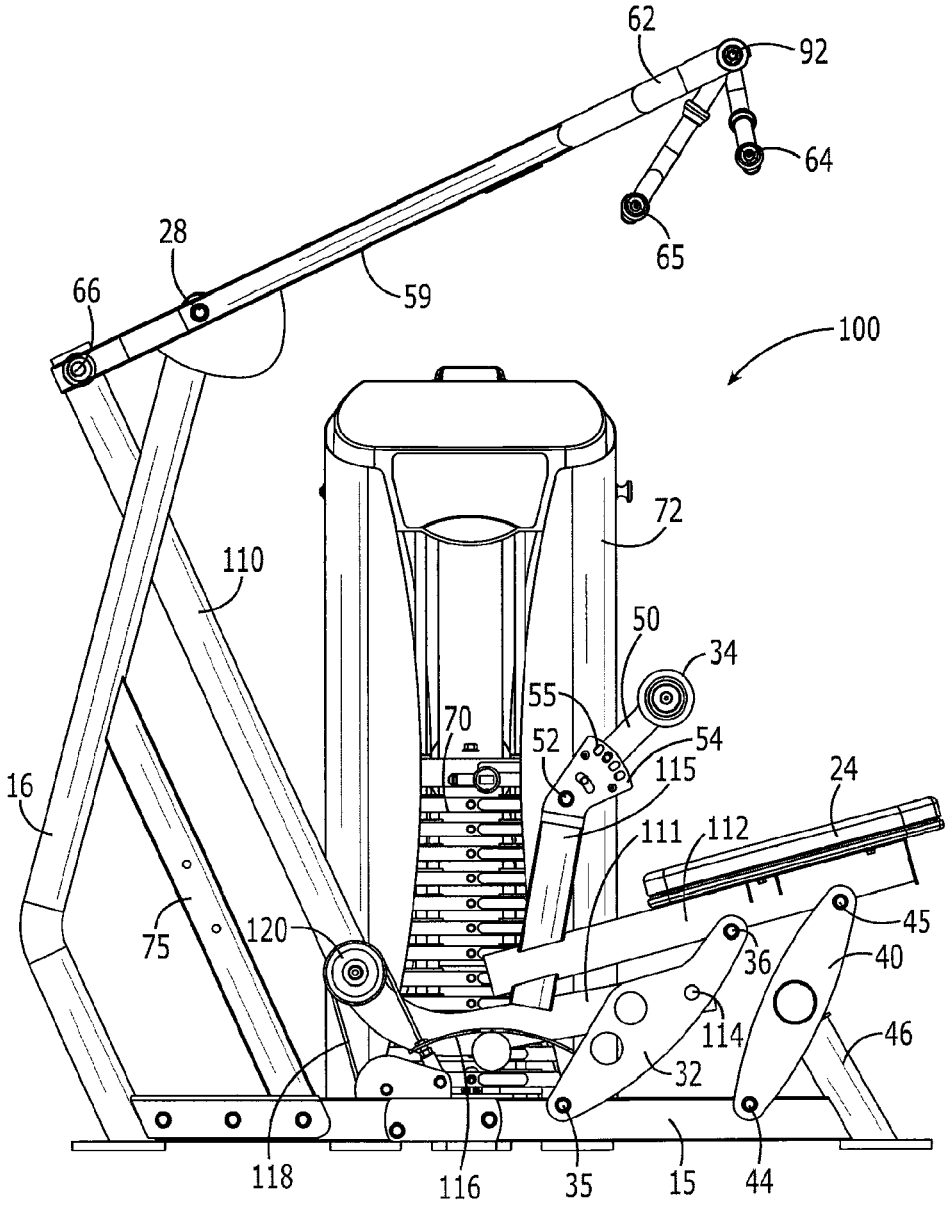
FIG. 9A is a side elevation view illustrating a second embodiment of a lat pulldown exercise machine in a start position for a lat pulldown exercise.
Figure 9B:
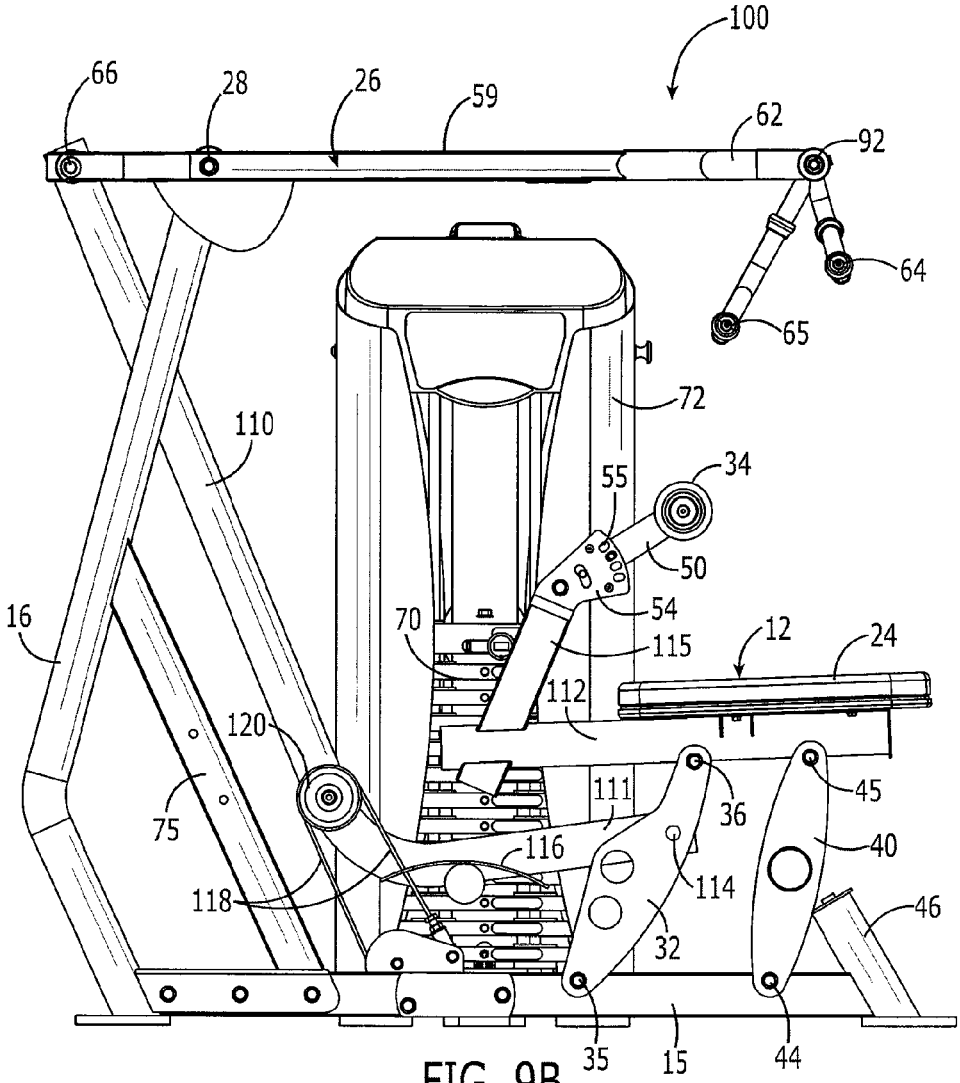
FIG. 9B is a side elevation view of the machine of FIG. 9A illustrating a finish position for the lat pulldown exercise.
Figure 10A:
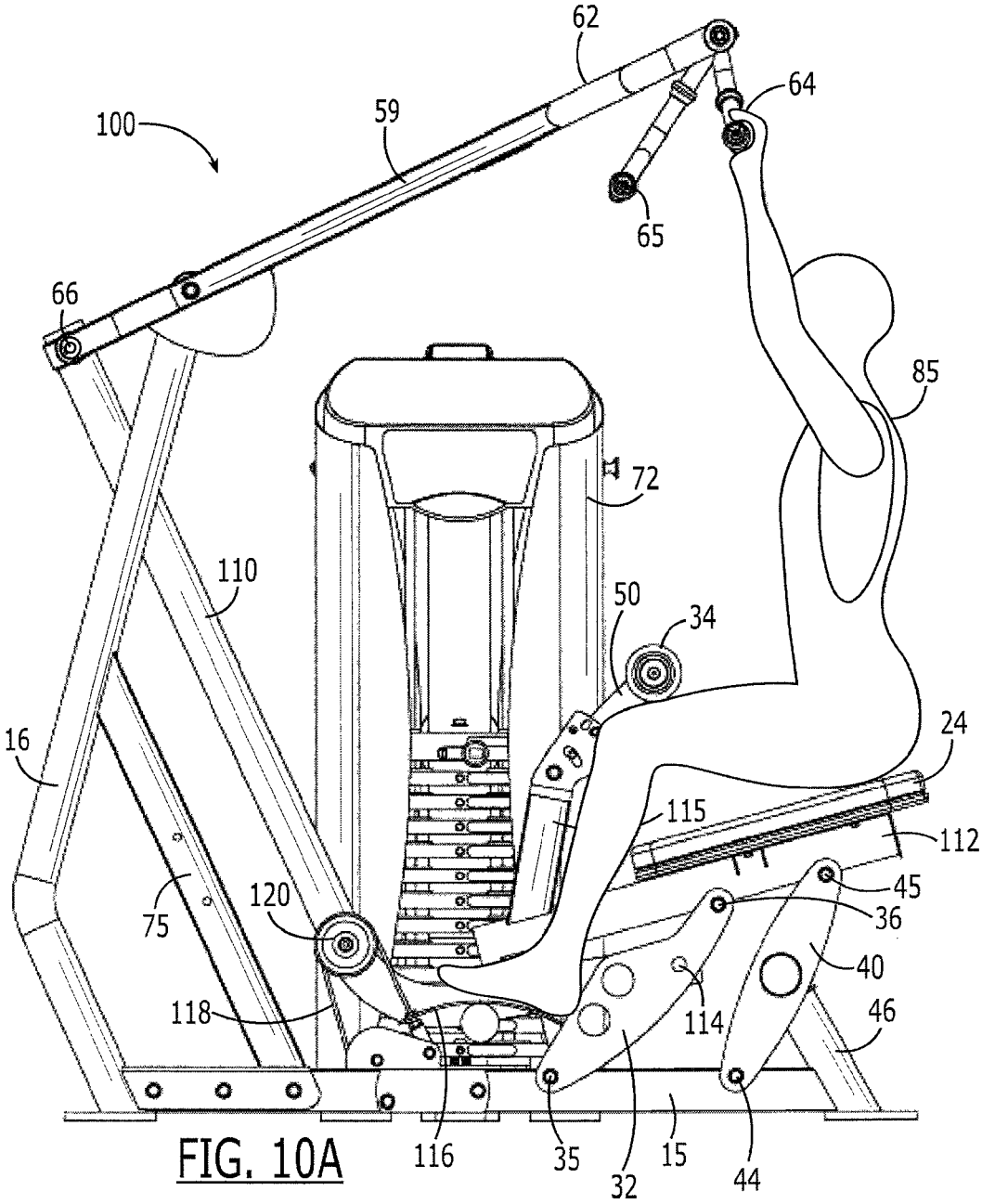
FIGS. 10A and 10B are views similar to FIGS. 9A and 9B but illustrating a seated exerciser performing a lat pulldown exercise on the machine.
Figure 10B:
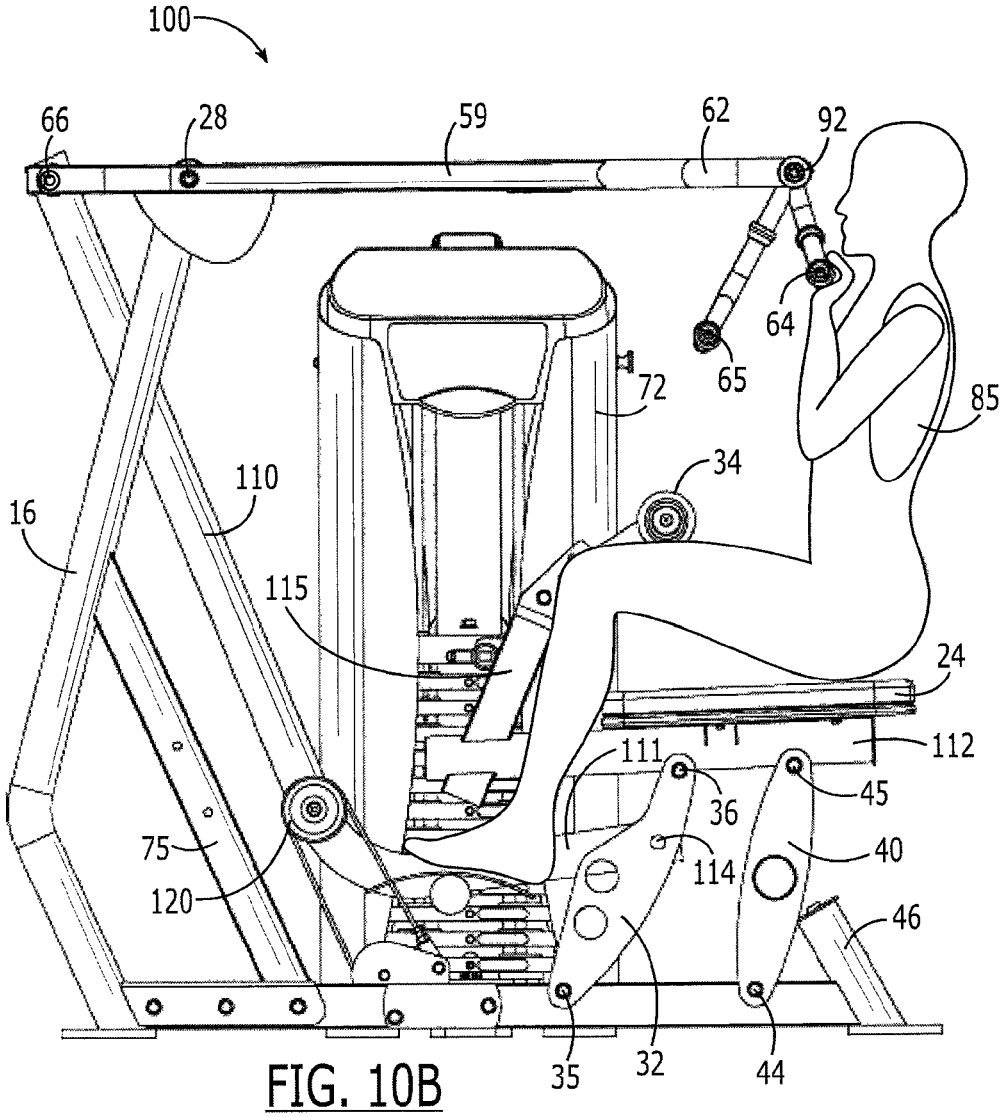

FIGS. 9A and 9B show the start and finish positions for a second embodiment of a lat pulldown machine 100, while FIGS. 10A and 10B show the same positions with a user positioned on the machine. Machine 100 is similar to the design of FIGS. 1 to 8 except for a modified connecting link 110 with additional functions as explained below, and like reference numbers are used for like parts as appropriate. In this version, the connecting link 110 pivotally connects the exercise arm or user engagement device 26 to one of the links 32 of the user support pivot system, rather than connecting to the user support. Link 110 has a rearwardly curved extension 111 which extends under the user support frame 112 and is pivotally attached to link 32 for rotation about pivot axis 114 beneath seat pad 24. The user support frame 112 is shorter than in the previous embodiment, and terminates slightly in front of modified thigh hold down mount 115. In this embodiment, the thigh hold down mount does not extend down to support foot rests as in the previous embodiment. Instead, the foot rests 116 are mounted on the extension 111 of connecting link 110. However, the thigh hold down assembly at the upper end of mount 115 is the same as in the previous embodiment, and like reference numbers have been used as appropriate.

In this embodiment, the resistive load is attached to the connecting link 110 rather than attaching to the user support. The selectorized weight stack 70 is linked to the connecting link 110 via a pulley and cable linkage, part of which can be seen in FIGS. 9 and 10. A first cable 118 extends from an anchor on the base section 15 of the main frame, around a first pulley 120 on the connecting link 110, around a second pulley (not visible) in the base section, and the cable is then linked in any appropriate manner, such as additional pulleys and cables not visible in the drawings, to the weight stack 70.

In the first embodiment of FIGS. 1 to 8, the foot rests 58 traveled in a fixed position relative to the user support seat 24. In this embodiment, the foot rests 116 travel in relationship to the user support seat during the exercise movement. However, the movement of the foot rests 116 is not in a fixed relationship with the seat movement, as can be seen by comparison of the foot positions of the user 85 in FIGS. 10A and 10B relative to the seat positions. In all other aspects, the pulldown exercise machine 100 of FIGS. 9 and 10 functions in an equivalent manner to that of FIGS. 1 to 8, as described above in connection with the first embodiment, with the start and finish positions of the user 85 in FIGS. 10A and 10B being almost identical to the user start and finish positions illustrated in FIGS. 2A and 2B. The four bar pivot linkage has a theoretical pivot axis above the user support, in a similar or identical position to that shown in FIG. 8 of the previous embodiment.

Figure 11A:
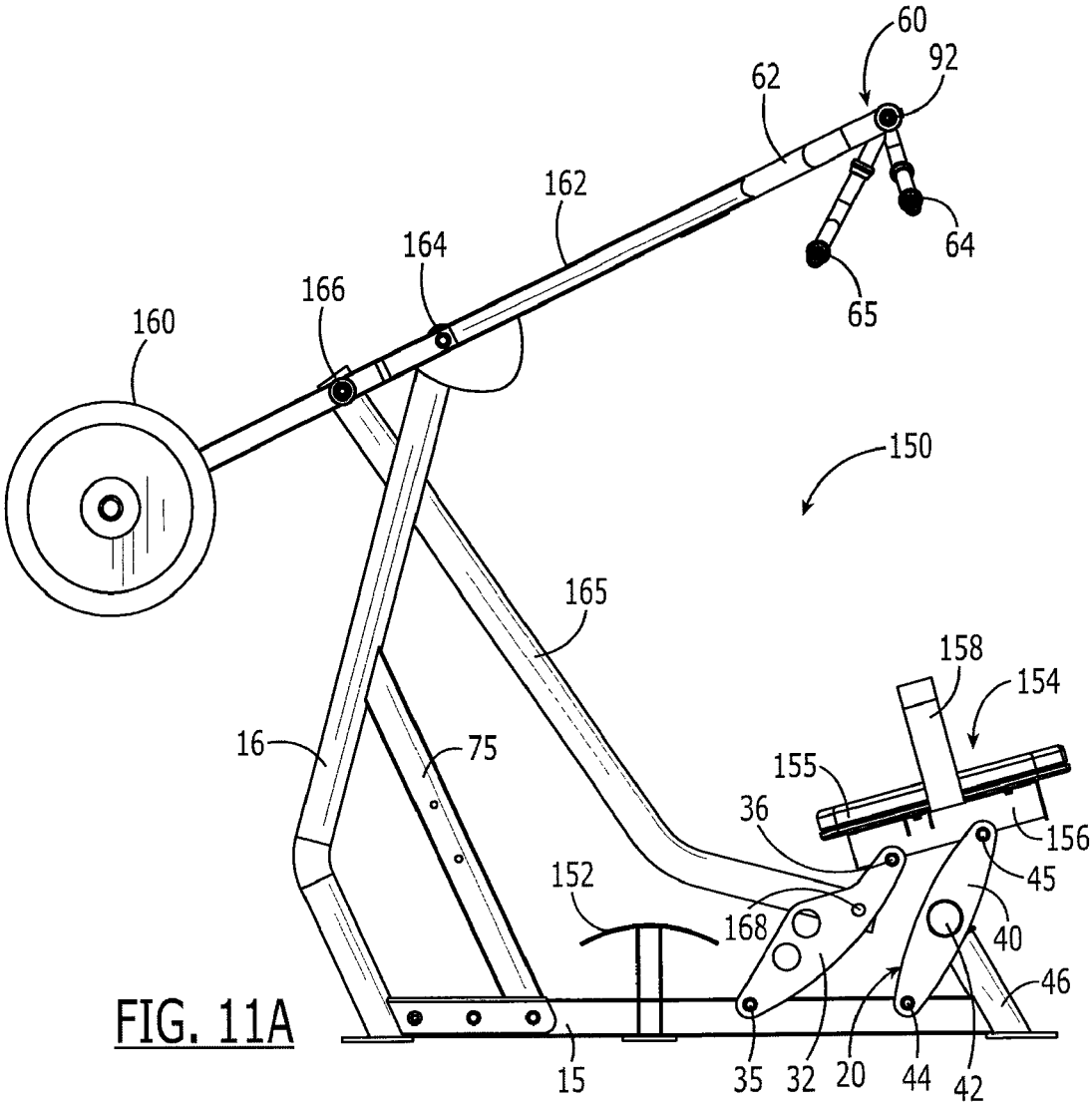
FIG. 11A is a side elevation view illustrating a third embodiment of a lat pulldown exercise machine in a start position for a lat pulldown exercise.
Figure 11B:
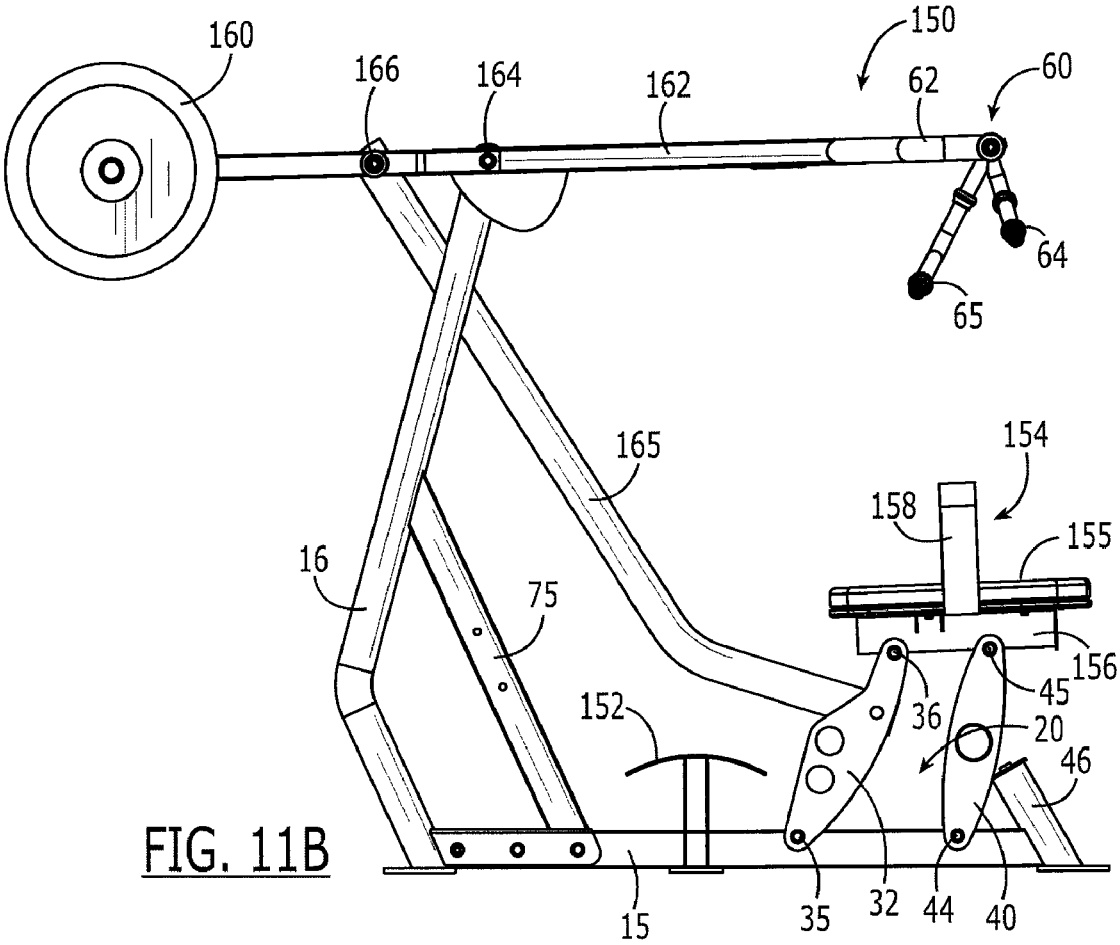
FIG. 11B is a side elevation view of the machine of FIG. 11A illustrating a finish position for the lat pulldown exercise.
Figure 12A:
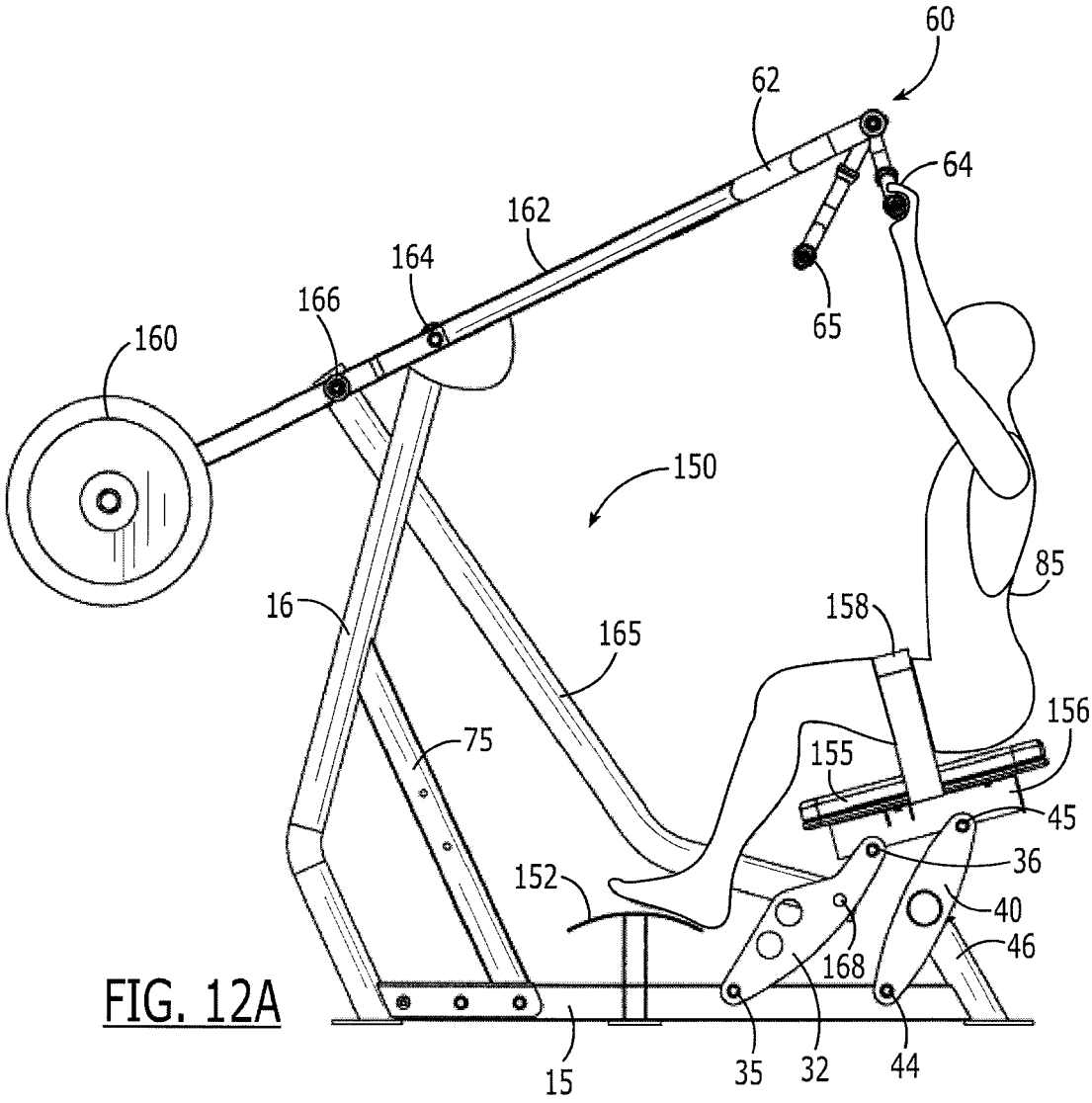
FIGS. 12A and 12B are views similar to FIGS. 11A and 11B but illustrating a seated exerciser performing a lat pulldown exercise on the machine.
Figure 12B:
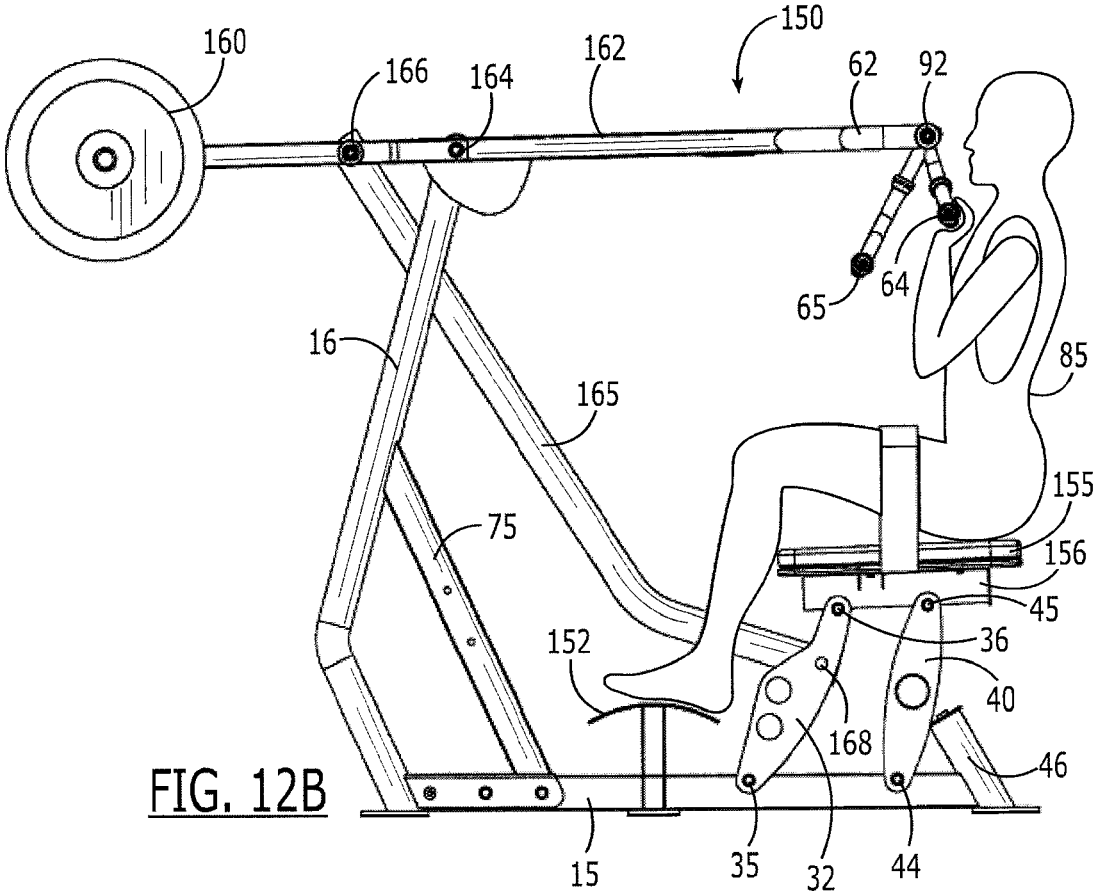

FIGS. 11A and 11B show the start and finish positions of a modified lat pulldown exercise machine 150 according to another embodiment. FIGS. 12A and 12B illustrate the same positions but with a user seated on the user support. This version is similar to that of the second embodiment in that the connecting link links the exercise arm with the user support pivot system, and like reference numerals have been used for like parts as appropriate. This version also has an identical four-bar pivot linkage system 20 to the previous embodiments. However, machine 150 is different from the machines described above in several respects. The foot rests 152 of machine 150 are mounted on the base section 15 of the main frame and are stationary, rather than traveling in relationship to the movement of the user support seat as in the previous embodiments. In this embodiment, the user support 154 is shorter and comprises a seat pad 155 mounted on a seat support frame 156 located completely beneath the pad and not projecting beyond the forward edge of the seat pad, unlike the previous embodiments. The thigh hold down mount and adjustable thigh hold down pads 34 of the previous embodiments are replaced by a seat belt 158 which can be secured over a user's thighs, as indicated in FIGS. 12A and 12B.

As in the previous embodiments, the user support 154 is pivotally supported on the frame by means of a four-bar pivot linkage 20, having a first pair of links 32 pivotally attached to the base section 15 of the frame for rotation about first pivot axis 35 and pivotally attached to seat support frame 156 for rotation about second pivot axis 36. A second pair of pivoted links 40 are pivotally attached to the base section 15 for rotation about third pivot axis 44 and to the seat support frame 156 for rotation about fourth pivot axis 45. Links 40 are connected by a connecting shaft 42 which rests on stop or support post 46 in the start position of FIGS. 11A and 12A.

In this embodiment, the weight stack of the previous embodiments is eliminated and the resistive load is instead supplied by hand-loaded weight plates 160 that mount to a first end of the exercise arm 162. The hand grip assembly 60 at the second end of arm 162 is the same as in the previous embodiments and like reference numerals are used as appropriate.

As in the previous embodiments, exercise arm 162 is pivotally attached to frame upright 16 for rotation about pivot axis 164 at an intermediate point in the length of the arm. As noted above, the machine 150 has a connecting link 165 pivotally attached to the exercise arm at one end for rotation about pivot axis 166, and pivotally attached to four-bar pivot links 32 at the other end for rotation about pivot axis 168, similar to the arrangement in the embodiment of FIGS. 9 and 10.

In all other aspects this embodiment functions in the same way as the previous embodiments and produces similar start and finish positions and a similar movement of the user support and user when pulldown exercise are performed, as can be seen by comparison of the user positions in FIGS. 12A and 12B with those of FIGS. 2A and 2B and 10A and 10B.

Figure 13A:
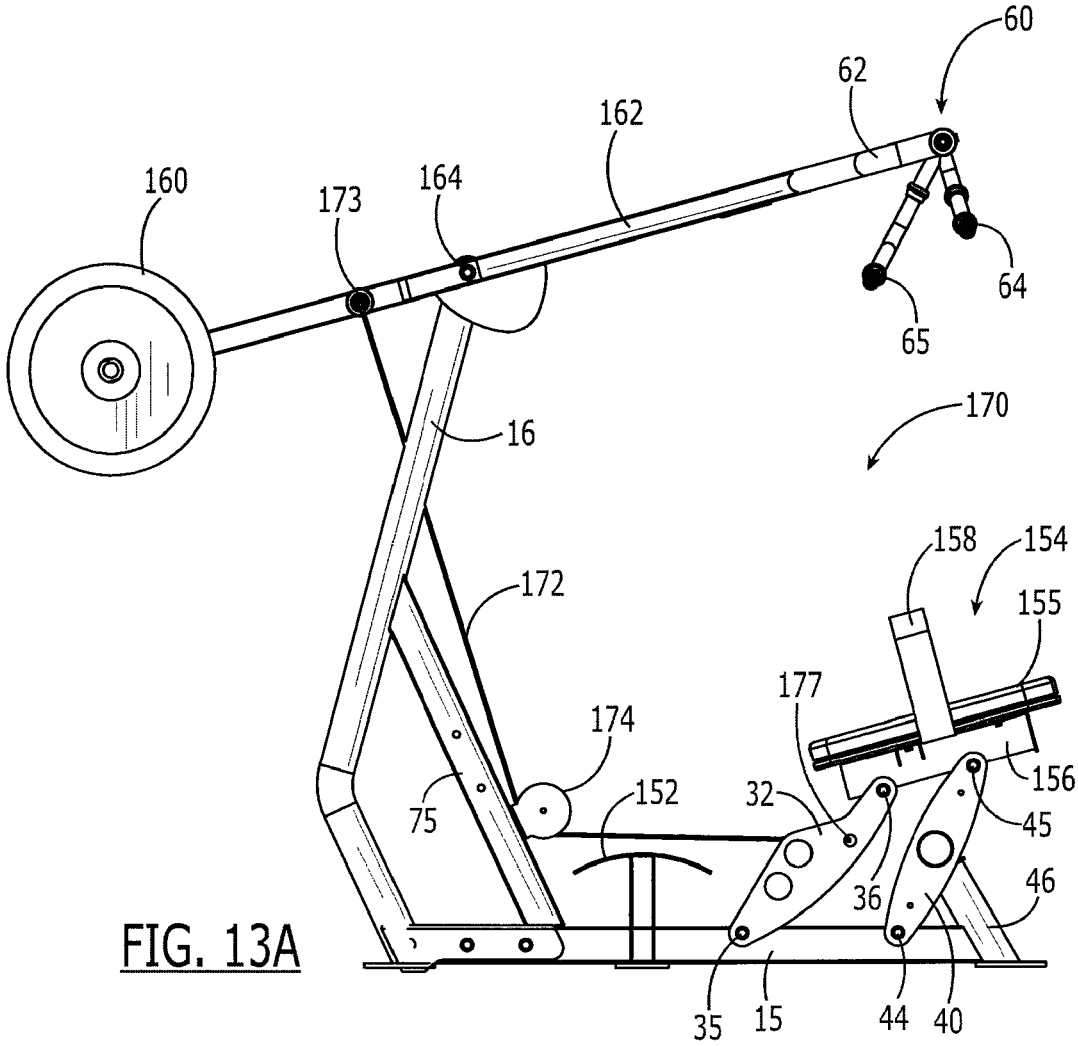
FIGS. 13A and 13B are side elevation views of a fourth embodiment of a lat pulldown machine illustrating the start and finish position of a lat pulldown exercise.
Figure 13B:
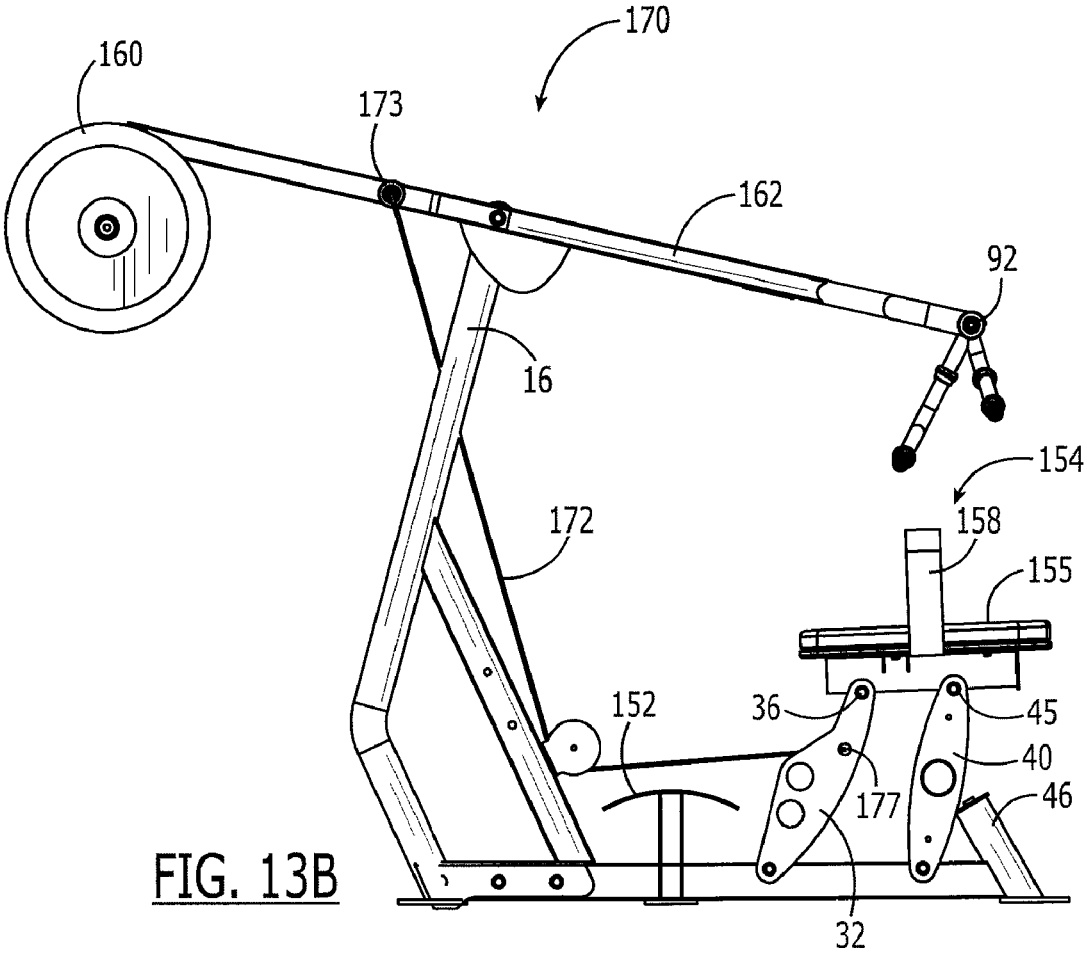

FIGS. 13A and 13B illustrate the start and finish position of a lat pulldown exercise machine 170 according to another embodiment. This is similar to the embodiment of FIGS. 11 and 12, and like reference numbers are used for like parts as appropriate. In this embodiment, the solid connecting link 165 of FIGS. 11 and 12 has been replaced by a cable or flexible line 172 which extends from an anchor point 173 on exercise arm 162 around a guide pulley 174 on inclined strut 75 and is anchored to link 32 of the four-bar pivot linkage system 20 at anchor 177. Each of the anchors is an articulating anchor. The exercise machine 170 functions in the same manner as the previous embodiment. The seated user in the start position of FIG. 13A pulls down on the selected hand grips 64 or 65, pulling the handle end of exercise arm 162 down and lifting the weight plates 160. This simultaneously pulls cable 172 upwards, pulling the user support pivot system and causing it to rotate the user support 154 into the finish position of FIG. 13B when the exercise arm is pulled downward by the user.

In each of the above embodiments, the four-bar pivot linkage between the user support and frame allows the theoretical pivot to be placed in the user support area while the actual pivoting action takes place below the user. These embodiments allow the exercise arm to adjust the position of the user support and keep the user in the proper exercise position at all times while substantially replicating the natural upper torso movement of a free-bar chin up exercise.

FIGS. 14 and 15 illustrate another embodiment of a rigid arm pull down machine 410 which allows a user to perform chin up type exercises similar to the free body weight exercise performed by a user pulling themselves up from the ground while gripping an overhead bar or "chinning" bar, with the user raising their body until their chin touches the bar. As in the previous embodiments, the exercise carried out with the machine 410 substantially mimics the natural body alignment in the start and finish positions of a free body weight chin up exercise. The machine 410 of FIGS. 14 and 15 is similar to that of FIGS. 1 to 8 but the four bar pivot linkage in this case does not have a theoretical pivot axis above the user support. Instead, in this embodiment, the theoretical pivot axis 477 is beneath the user support. Another difference in this embodiment is the connecting link 438 which is pivoted between an intermediate point on the exercise arm 426 and the forward end of the user support frame, while the forward end of the exercise arm is linked to the load or weight stack.

The machine 410 comprises a main frame having a horizontal base section 412 and an upright section 414, a generally T-shaped user support frame 415 pivotally mounted on the base section via pivot mount 416, and an exercise arm 418 pivotally mounted at the top of the upright section 414 of the frame. The upright section 414 of the frame includes a vertical housing 420 containing a weight stack (not visible in the drawings), and a slightly forwardly inclined upright strut 422. A horizontal strut 424 extends between the top of housing 420 and the upright strut 422.

The exercise arm 418 comprises a generally U-shaped member 425 with a forward projecting arm portion 426 extending from the mid-point of the U-shaped member and pivoted to the upper end of strut 422 for rotation about pivot axis 428 at a mid point in its length. The forward end of arm 426 is linked to the weight stack via a cable 430 extending from anchor 432 on the horizontal strut 424, over a pulley 433 at the end of arm 426, then back around pulley 434 on strut 424 and via additional pulleys (not visible in the drawings) to the top of the weight stack. A U-shaped handle bar 435 is pivoted at pivot 436 to the ends of the U-shaped member 425 so as to be suspended downwardly from bar 425 above the user support for gripping by a user.

An adjustable length connecting link 438 pivotally connects the exercise arm 418 to the user support frame 415. The link 438 has a first end pivoted to the portion 426 of the exercise arm for rotation about pivot axis 440 which is spaced to the rear of the pivot axis 428. The second end of connecting link 438 is pivoted to the user support frame 415 at pivot 442. The link 438 comprises two telescopically engaging parts which are secured together at a selected extension via a spring loaded pull pin 444 engaging in a selected opening 445 in one of the telescoping parts.

The user support frame 415 is generally T-shaped, having a base member 446 and an upright member 448 projecting upwardly from the central region of member 446. A seat pad or primary support 450 is mounted at the rear end of base member 446, facing upright member 448, and a foot rest or stabilization means 452 is mounted at the forward end of member 446. The connecting link pivot 442 is provided on a pivot bracket 454 adjacent foot rest 452. A secondary user support is provided at the upper end of upright member 448, and comprises a pair of thigh hold down or roller pads 455 on a strut 456 telescopically mounted in member 448. The position of the roller pads 455 can be adjusted by moving strut 456 up or down and then securing it in position via a spring loaded pull pin 458.

The user support frame is pivotally mounted on base 412 via a four bar linkage system comprising the base strut 446 of the user support, the pivot mount 416, and a pair of pivot links 460,462. The first pivot link 460 is pivoted at one end to the rear end of pivot mount 416 for rotation about pivot axis 464, and to the rear end of base strut 446 of the user support at the opposite end for rotation about pivot axis 465. The second pivot link 462 is pivoted at one end to the forward end of the pivot mount 416 for rotation about pivot axis 466, and at the opposite end to the forward end of the base strut 446 for rotation about pivot axis 468.

Figure 14B:
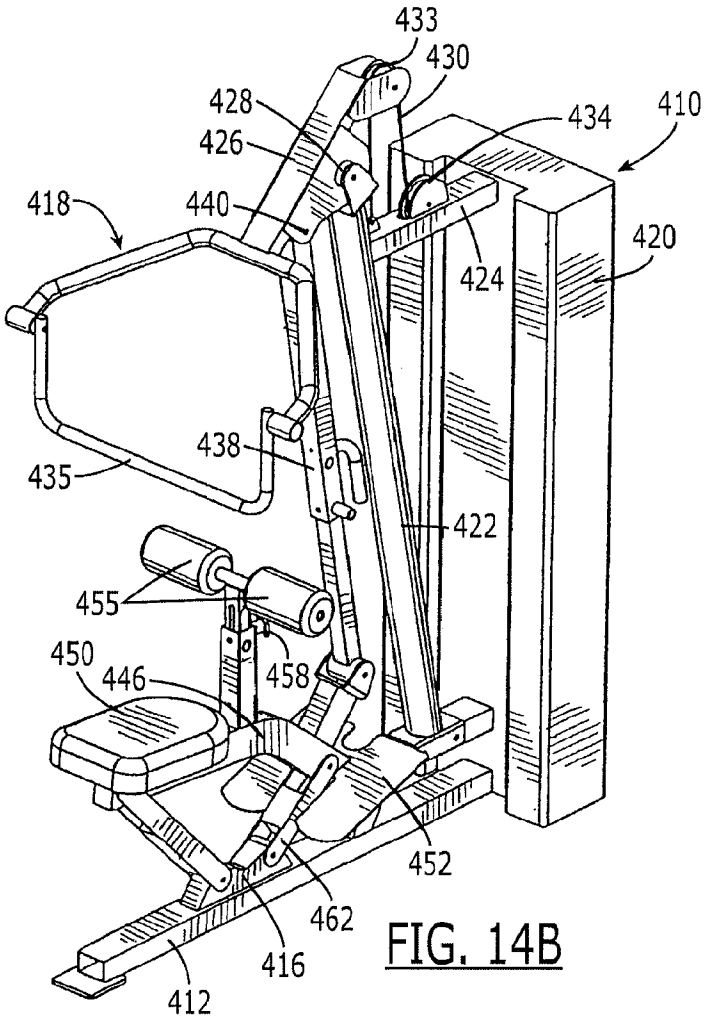
FIGS. 14A and 14B are side elevation views of another embodiment of a lat pulldown machine illustrating the start and finish position of a lat pulldown exercise.
Figure 14A:
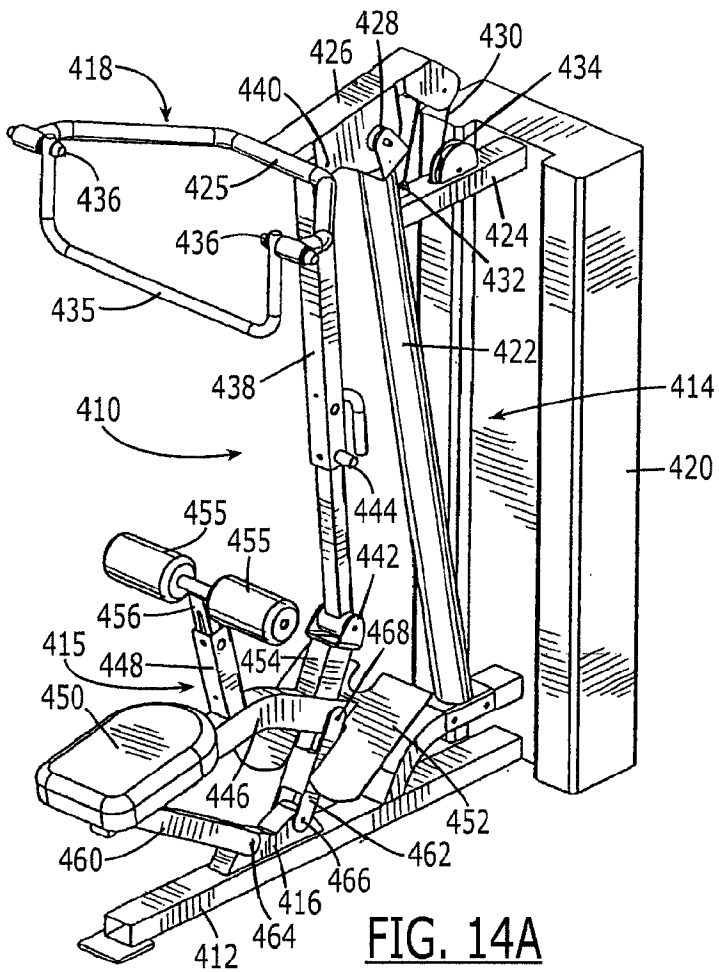
Figure 15B:
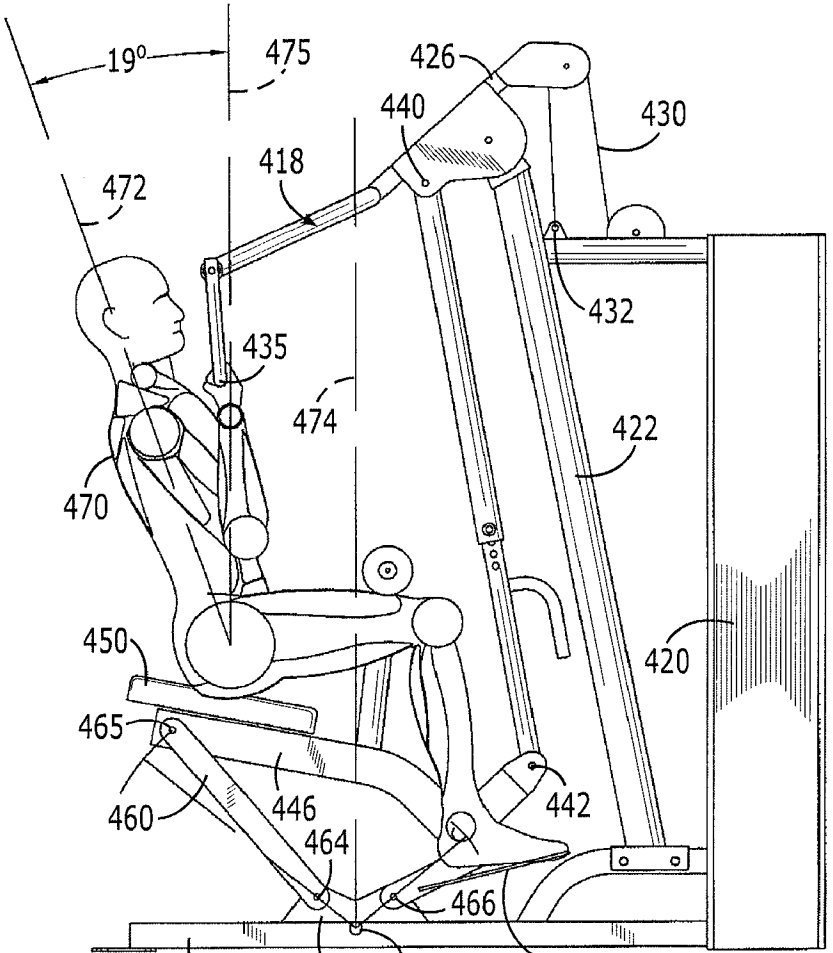
FIGS. 15A and 15B are views similar to FIGS. 14A and 14B but illustrating a seated exerciser performing a lat pulldown exercise on the machine.
Figure 15A:
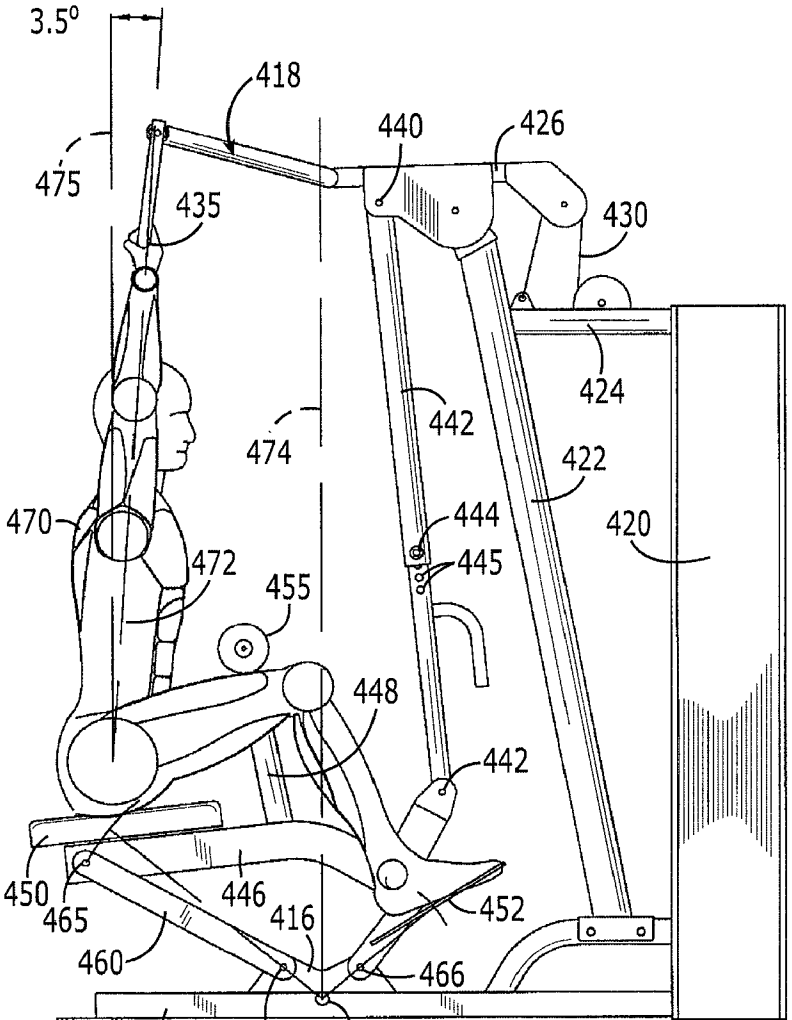

FIG. 14A illustrates the start position of the rigid arm pull down machine without an exerciser, while FIG. 14B illustrates the finish position. FIGS. 15A and 15B illustrate the same positions with the user 470 in place to perform a chin up exercise. At the start of the exercise, the user is in a seated position on seat pad 450 facing the front end of the machine. In this embodiment, the seat pad starts in a slightly downwardly reclined orientation as illustrated in FIGS. 14A and 15A. They then slide their legs under the thigh hold down roller pads 455, adjusting the position of these pads by sliding the strut 456 up and down if necessary, and place their feet on the user support footrest or plate 452. They then grab the handle bar 435 of the exercise arm 418 and pull it downwards. The starting position of FIG. 15A places the user's upper body in a slightly forward lean with their arms extending straight overhead, in line with the side center line 472 of their body. If necessary, the user can adjust the distance between the user support seat 450 and exercise arm bar or handle 435 by adjusting the length of connecting link 438.

As the exercise arm 418 moves downwards, rotating about the pivots 428 and 440, the connecting link 438 pushes the forward end of the user support frame 415 downwards, rotating the frame about the four bar linkage into the finish position illustrated in FIG. 15B, in which the seat pad 450 is moved into an upwardly inclined orientation. At the same time, the selected weights in the weight stack are lifted via the cable and pulley linkage between the forward end of the exercise arm and the weight stack. As the seat pad changes its orientation from a reclined angle to an inclined angle, the user automatically adjusts their upper body position rearward (relative to their angular position on the seat) to compensate for this change in seat angle, and finishes the exercise with their hands below their chin and slightly in front of their shoulders. This slight rearward movement mimics the natural rearward arc a person's upper body goes through when performing a free bar chin up exercise.

In this embodiment, due to the different orientation of the forward pivot link towards the front end of the machine, the theoretical pivot axis is positioned beneath the user support. However, as in the previous embodiments, a substantial portion of the combined weight of the user and the support frame is positioned on each side of the gravitational center line 474 of the theoretical pivot axis in both the start and finish position. The portion of both the user and the user support positioned on each side of line 474 varies only very slightly from the start to the finish point of the exercise movement. This balanced distribution minimizes the effect that the combined weight of the user and user support has on the exercise resistance, while still allowing it to act as a counter balance to offset the weight of the exercise arm. The combined weight of the user and support has little effect on the amount of starting resistance, because a substantially equal amount of weight is balanced rearward of the user support pivot. By the same token, because only a small portion of the user passes through the gravitational center line 474 during the exercise, there is no appreciable drop off in resistance felt by the user.

The line 475 in FIGS. 15A and 15B represents the perpendicular or vertical centerline of the user in both the start and finish positions, while line 472 is the side centerline. As illustrated in FIG. 15A, at the start of the exercise, the user is in a forward lean of approximately 3.5 degrees off vertical, with their arms fully extended and in line with the body side centerline. At the end of the exercise, as illustrated in FIG. 15B, the user is reclining at approximately 19 degrees to the vertical centerline 475, with their hands positioned under the chin and slightly forward of their shoulders. Thus, the upper body moves through an angle of approximately 22.5 degrees. The pull down exercise machine 410 closely mimics the natural movement and body alignment found in a free bar chin up exercise.

In this embodiment, the primary user support is the seat pad 450, while a secondary support is provided by the thigh hold-down pads 455. A further support or stabilization means is provided by the foot pads 452 which travel with the user support frame 415. The multiple user supports help to provide proper positioning of the user relative to the user engaging portion of the exercise arm throughout the entire exercise movement. This also makes the apparatus much more comfortable and natural for the user, making the user want to exercise. The foot pads keep the user's feet in the same relaxed and supported position throughout the entire exercise movement.

The rigid arm pull down machine 410 places the user's body in a slightly forward lean at the start of the exercise, to compensate for the reclined angle of the seat, with their arms extended straight overhead and in line with their body side centerline. The body orientation changes to a reclined angle mimicking the natural rearward arc the body goes through when performing a chin up exercise, with the user finishing the exercise with their arms under their chin.

FIGS. 16 through 23 illustrate a pivoting user support system similar to that of the previous embodiments on a lat mid row machine 200 according to another embodiment. As explained in more detail below, the machine 200 has a four-bar pivot linkage 210 supporting the pivoting user support 212 which allows the theoretical pivot to be placed in the user support area but has the actual pivoting action take place below the user, as in the previous embodiments. This design allows the exercise arm to adjust the position of the user support and helps to position the user in the proper exercise position at all times while substantially replicating the natural upper torso movement during a rowing exercise.

Figure 21:
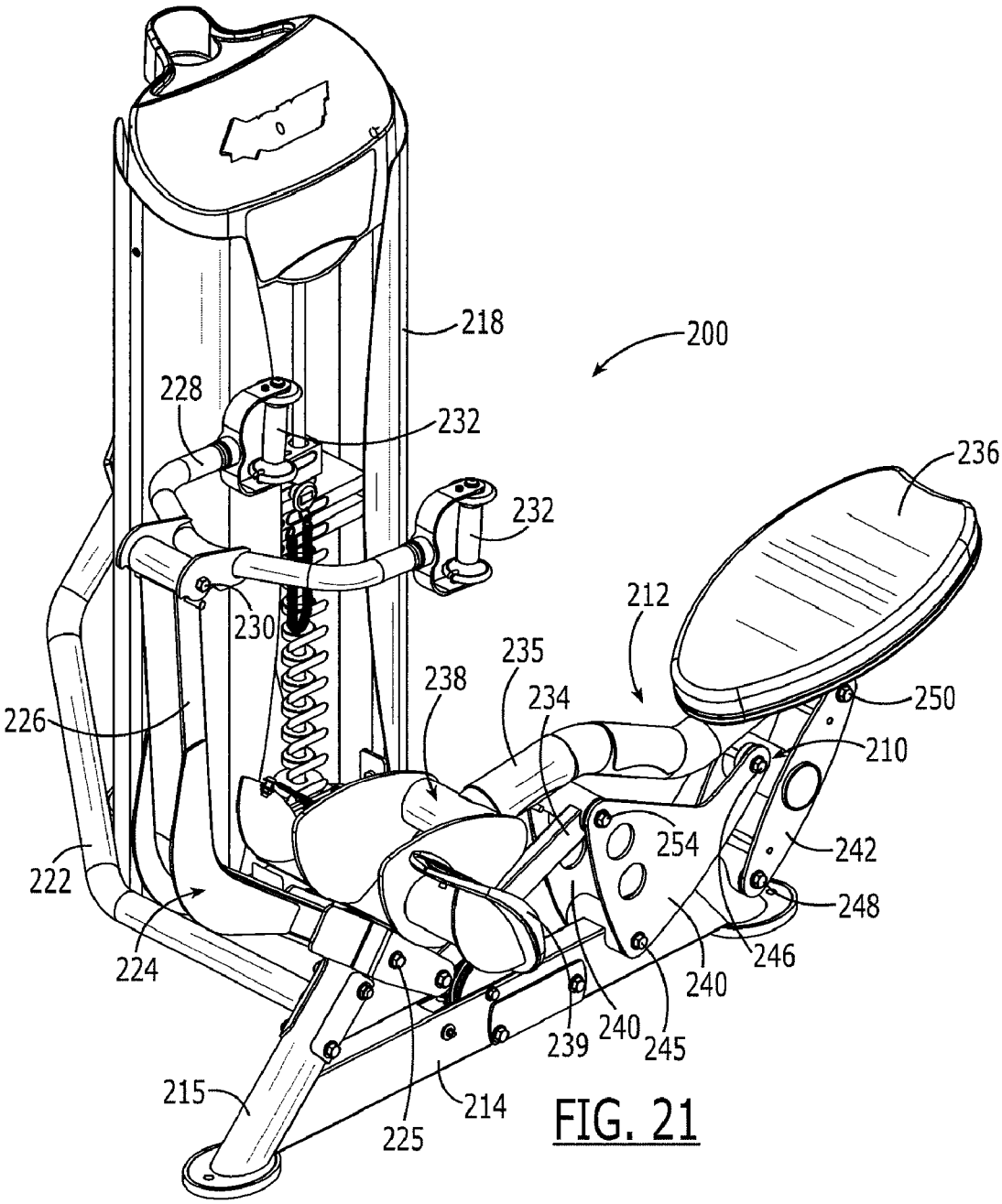
FIG. 21 is a front perspective view of the machine of FIGS. 16 to 20.
Figure 22:
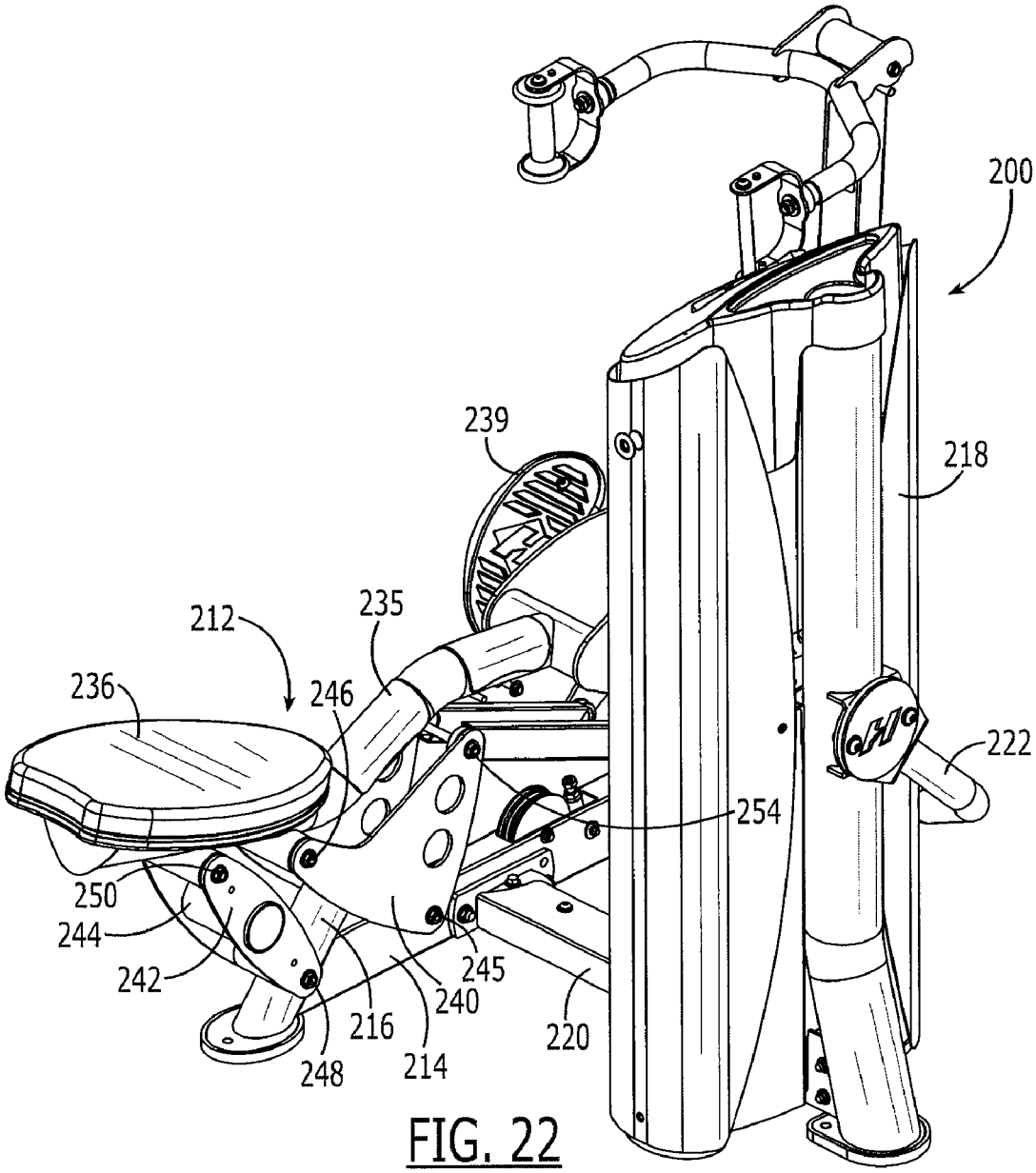
FIG. 22 is a rear perspective view of the machine of FIGS. 16 to 21.

Machine 200 has a main frame consisting of a horizontal base section 214 with a first inwardly angled upright or strut 215 at one end and a second, shorter inwardly angled upright or strut 216 at a second end. The second strut 216 acts as a stop or support for the four-bar linkage 210 in the start or rest position of FIGS. 16A and 17A. The main frame is connected to a vertical weight stack support frame 218 in a similar manner to the first and second embodiments described above. As in the first and second embodiments, the weight stack support frame 218 can be selectively mounted on either side of the main frame, by means of the cable guide tube 220 and weight stack connecting rod 222 which are releasably secured between the main frame and weight stack frame, as illustrated in FIGS. 21 and 22. The weight stack support frame houses a weight stack running on two guide rods as is standard in the field. A cable and pulley system connects the elongated seat section of the user support with the weight stack to provide resistance to movement by the user support. This is commonly known as a selectorized machine. Part of the cable and pulley system can be seen in FIGS. 16A and 16B, comprising a cable 221 extending from the base section 214 of the main frame around a pulley 223 on a forward portion of user support frame or strut 235, and then back around a pulley 219 on the base section 214.

A user engagement device or exercise arm assembly 224 is pivotally mounted at a location between its two ends to the front angled upright 215 of the main frame for rotation about a pivot axis 225. The exercise arm assembly consists of an upwardly projecting exercise arm 226 with user engaging handle bar 228 pivotally mounted to its first end for rotation about pivot axis 230. Handle bar 228 has hand grips 232 rotatably mounted at its opposite ends for gripping by a user when performing rowing exercises. A connecting link 234 connects the second end of the exercise arm 226 with the four-bar pivot linkage 210, as described in more detail below.

The user support has an elongated user support frame 235 with a seat cushion or pad 236 for supporting an exerciser mounted at a rear end portion of the frame 235 and a footrest section 238 mounted on the frame 235 at a location spaced forward from the user support seat pad 236. The footrest section 238 has spaced footrests 239 on each side of frame 235 for engaging the user's feet as indicated in FIGS. 15A and 15B while performing a rowing exercise.

The user support pivot system or four-bar pivot linkage 210 is best illustrated in FIGS. 21 and 22 and comprises two spaced, parallel forward links 240 and a single rearward link comprising spaced link plates 242 connected together by shaft or connecting rod 244. The forward links 240 are pivotally mounted to the base section 214 of the main frame for rotation about first pivot axis 245 and are pivotally mounted to the user support frame 235 for rotation about second pivot axis 246. The rearward link plates are pivotally mounted to the rear inclined strut 216 for rotation about third pivot axis 248 and to the user support frame 235 at a location spaced rearward from pivot axis 246 for rotation about fourth pivot axis 250. This produces a four-bar linkage which pivotally connects the user support 212 to the main frame via the links of the user support pivot system.

The connecting link 234 pivotally connects the exercise arm 226 with the user support pivot system 210 and converts rearward movement of the exercise arm (about its pivotal connection to the forward upright 215) into upward movement of the user support. Connecting link 234 is pivotally attached at one end to a second end of exercise arm 226 for rotation about pivot axis 252, and is pivotally attached at the opposite end to the forward links 240 of the pivot system 210 for rotation about pivot axis 254.

Forward links 240 of the four-bar pivot linkage are of a somewhat triangular shape and the three pivot axes 245, 246, and 254 are located generally at corner regions of the triangular shape. A stop pin or the like (not visible in the drawings) extending between links 240 rests on the upper end of post 216 in the start position of FIGS. 16A and 17A to support the user support in this position when the machine is not in use.

Figure 17A:
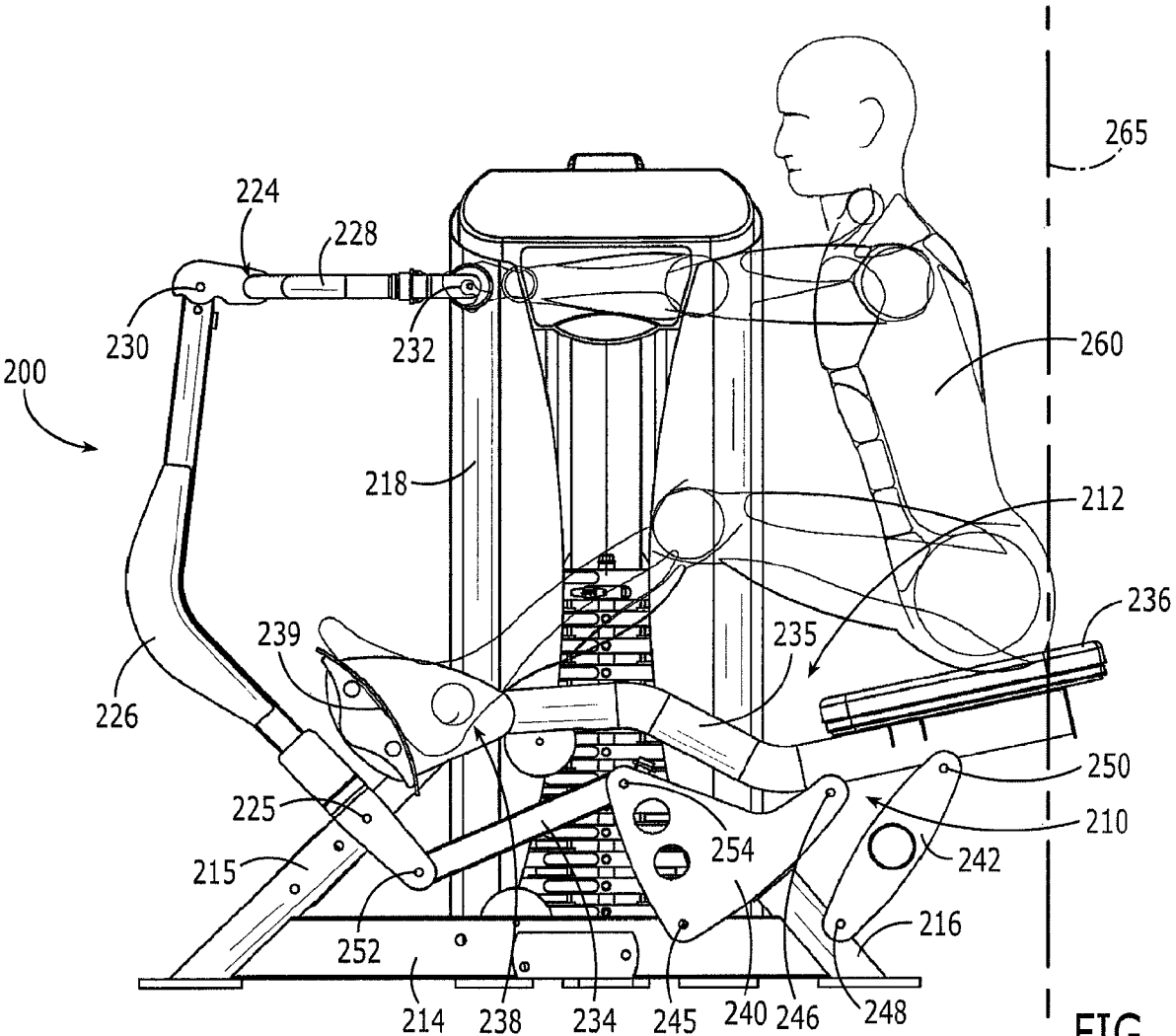
FIGS. 17A and 17B are views similar to FIGS. 16A and 16B but illustrating a seated exerciser performing a rowing exercise on the machine.
Figure 17B:
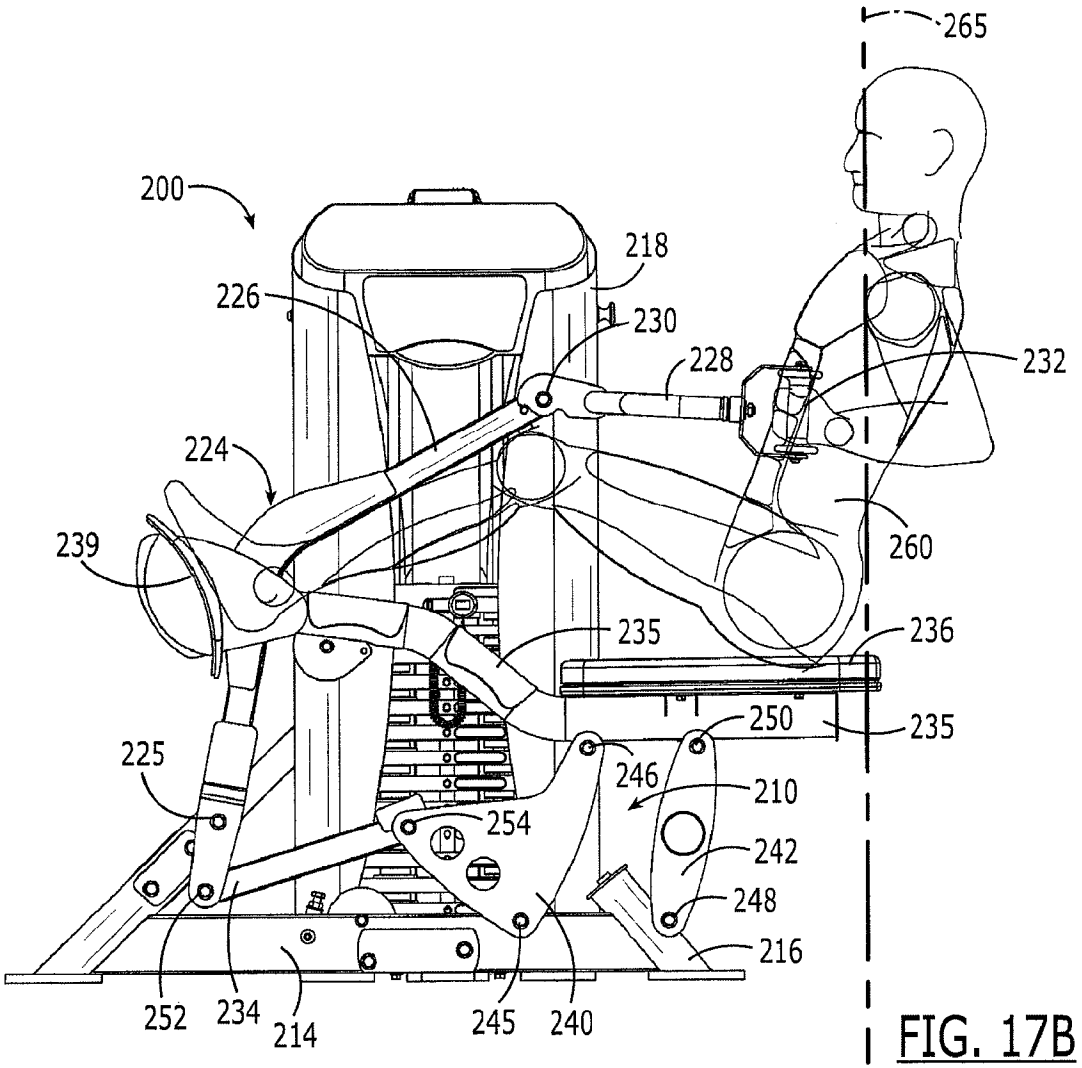
Figure 18:
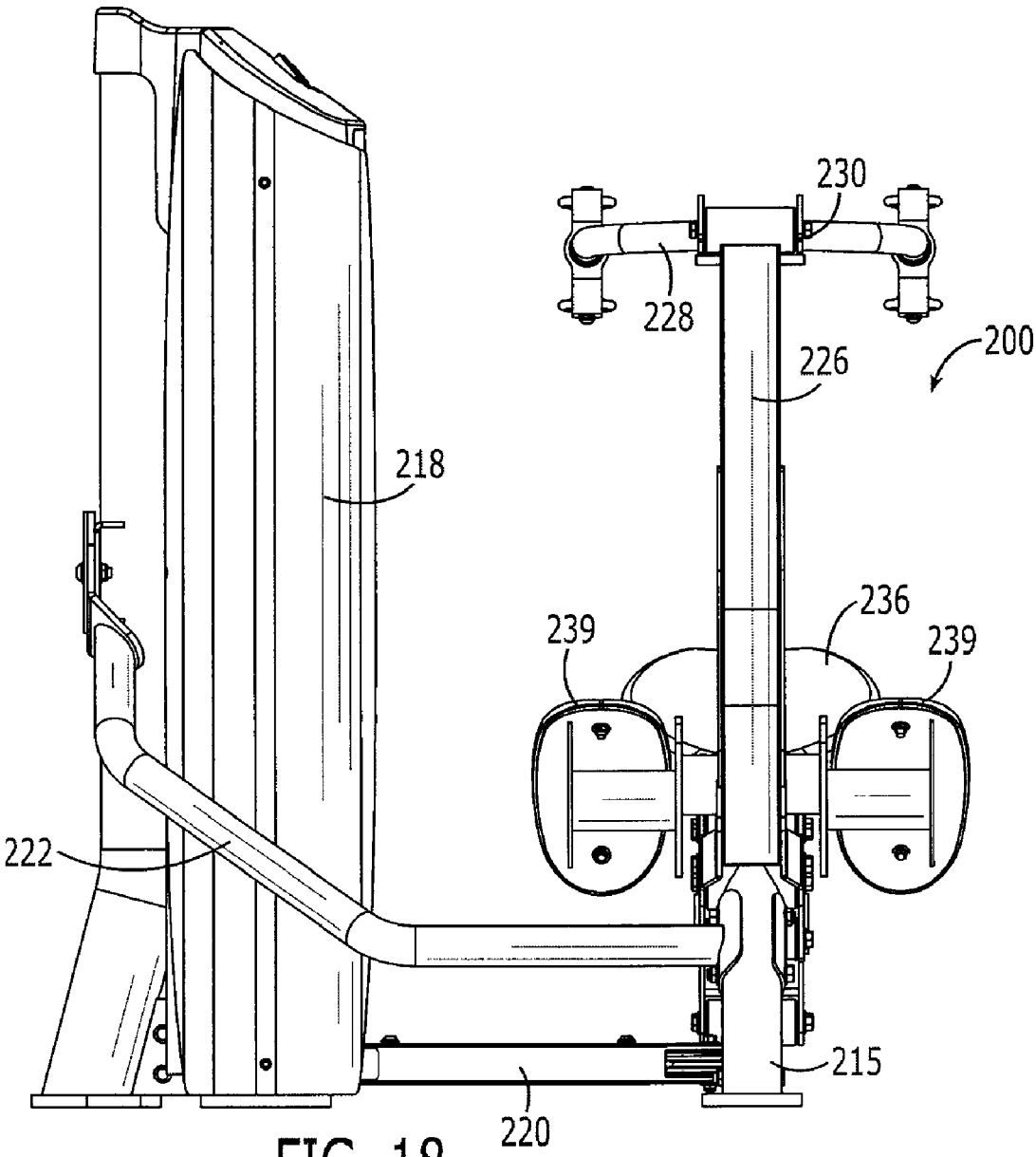
FIG. 18 is a front elevation view of the machine of FIGS. 16 and 17.
Figure 19:
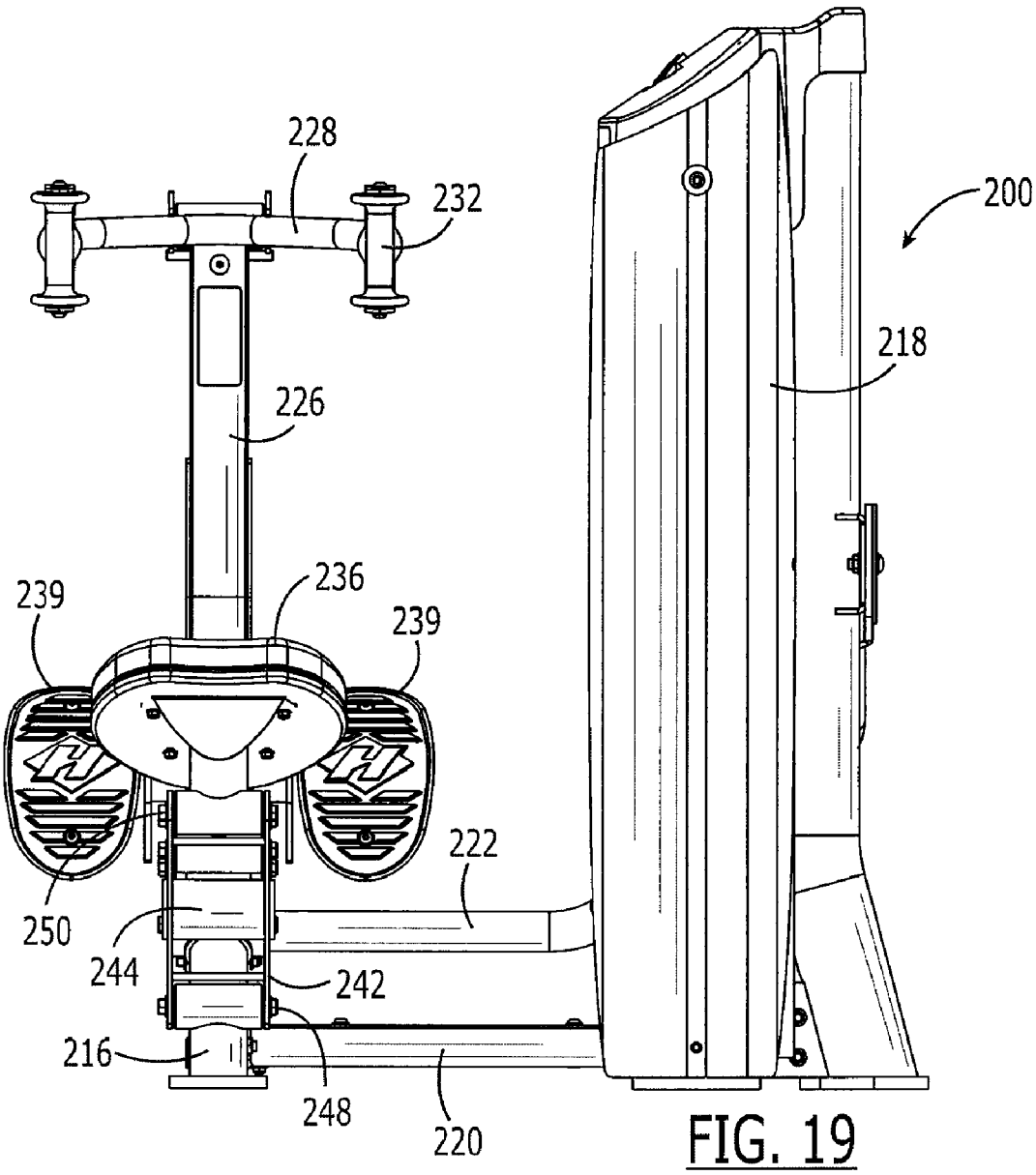
FIG. 19 is a rear elevation view of the machine of FIGS. 16 to 18.
Figure 20:
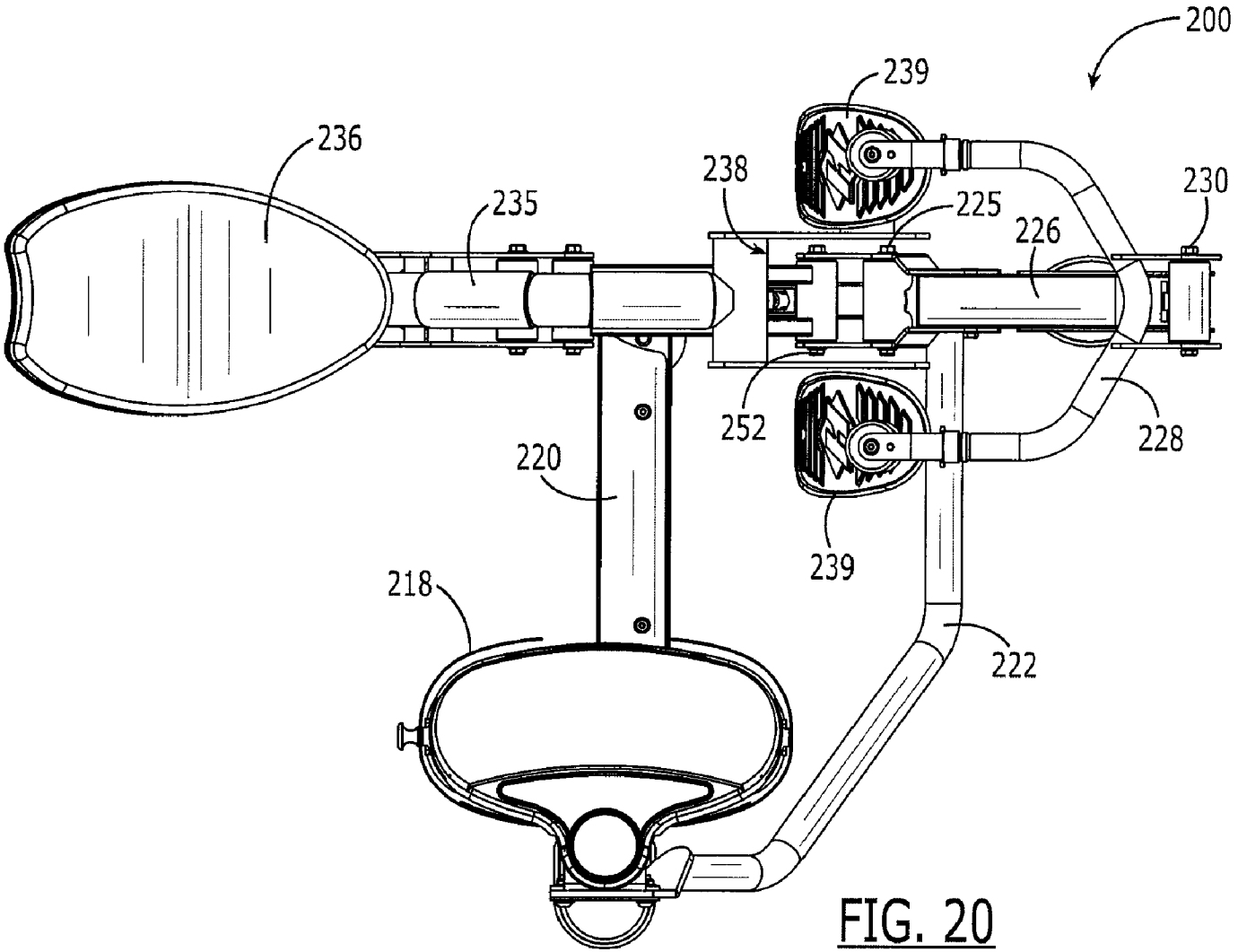
FIG. 20 is a top plan view of the machine of FIGS. 16 to 19.

FIGS. 17A and 17B illustrate start and finish positions of a user 260 performing a rowing exercise on the machine 200, with the dotted line 265 representing the gravitational centerline of the pivotal movement. To perform the exercise, the user 265 sits on the user support seat and places their feet on the foot rests 239 with their knees slightly bent. They then stretch forward and grab the user engaging handles or hand grips 232 on the handle portion 228 of the exercise arm, and pull the handles rearward at a downward angle towards their abdomen, causing the arm 226 to pivot about pivot axis 225 at its connection to the main frame. This pulls the connecting link 234 forwards, which in turn pulls the user support pivot system 210 and forces the user support 235 to rotate upward and forward about its pivotal connection to the main frame. The handle portion 228 is pivotally mounted on the exercise arm for rotation about pivot axis 230 and is designed to automatically adjust to the height of the user as well as self-align to the movement of the user's hands during the exercise. A pair of rotating grips 232 are mounted at the end of the handles which provide for hand pronation and supination and allow the user to choose multiple gripping positions.

The seat 236 goes from an incline to a substantially horizontal orientation between the start position of FIG. 17A and the finish position of FIG. 17B. At the same time, the user moves from a forward lean to a rearward lean and the user's hands go from extended forward to bent with elbows close to their side, hands at abdominal level. The gravitational centerline 265 of the pivoting motion runs just inside the end of the seat pad so that a portion of the user and user support is located on each side of the gravitational centerline in both the start and finish positions. The user support seat moves in one direction during the exercise movement while the upper torso of the user moves in the opposite direction. Because the user is securely positioned on the traveling user support, only a small adjustment at the hip is needed to duplicate the natural upper body movement/positioning adjustment when rowing. The amount of upper body movement, which depends on the combined travel of the exercise arm and user support, varies slightly with different size users.

As the handles are pulled towards the user and the arm rotates about its connection to the main frame, connecting link 234 is pulled forward which pulls the pair of parallel links 240 forward, forcing the four-bar user support pivot system to rotate. This four-bar linkage is designed to control the forward and upward movement of the user support seat and reorient the seat for an inclined to a substantially horizontal position while shifting the seat slightly forward.

During the exercise motion, the angle of the user support seat goes from inclined to substantially horizontal because movement in the four-bar pivot system dips the rear end of the user support seat as it raises the front end. It also shifts the pad forward slightly. This combined action moves more of the user support as well as a portion of the user onto the resistance side of gravitational centerline 265 illustrated in dotted outline in FIGS. 17A and 17B. This is done to offset or neutralize the rearward lean of the user as they follow the natural rowing motion and bring the exercise arm handles in towards their abdomen. By providing this forward shift to the user and user support there is no perceived shift in combined weight from one side of the gravitational centerline to the other and no noticeable effect on the exercise resistance felt by the user. Without this forward shift the user could feel a slight drop-off in resistance at the end of the exercise as their body leans rearward and shifts to the non-resistance side of the gravitational centerline.

In the starting position of FIG. 17A, the user has their arms extending forward with a slight forward lean to their upper body. In the finish position of FIG. 17B, the user's torso is in a slight recline, with the arms bent with elbows at the sides of the user's torso and the hands in front of the abdomen. This replicates the starting and finishing positions of an exerciser rowing a boat.

In this embodiment, the exercise arm pivot is positioned forward of the user support 212. The starting position places the user's upper body in a slightly forward lean to compensate for the inclined angle of the seat. As the exercise arm moves rearward, the user support frame pivots, bringing the seat section upward and changing its orientation from an inclined angle to a substantially horizontal orientation. The user automatically adjusts their upper body position rearward (relative to their angular position on the seat) to compensate for this change in seat angle. This slight rearward movement mimics the natural rearward arc a persons upper body goes through when rowing. This rearward lean is a natural by-product of a seated exerciser balancing on a moving seat, similar to that of a child riding on a seesaw. It is a very slight adjustment (pivoting at the waist) that goes practically unnoticed by the exerciser because they are in a stable, braced position and the user does not have to purposely adjust their body position during the exercise movement. The low profile of the user support makes it easy to enter and exit the user support area.

Figure 16B:
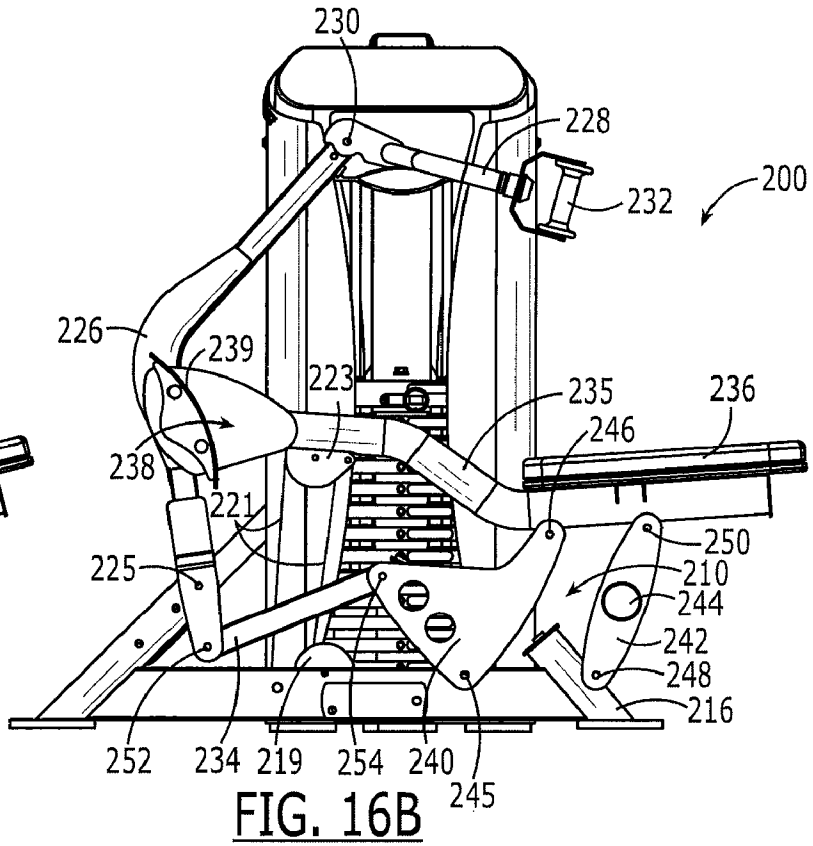
FIG. 16B is a side elevation view similar to FIG. 16A, illustrating an exercise finish position.
Figure 16A:
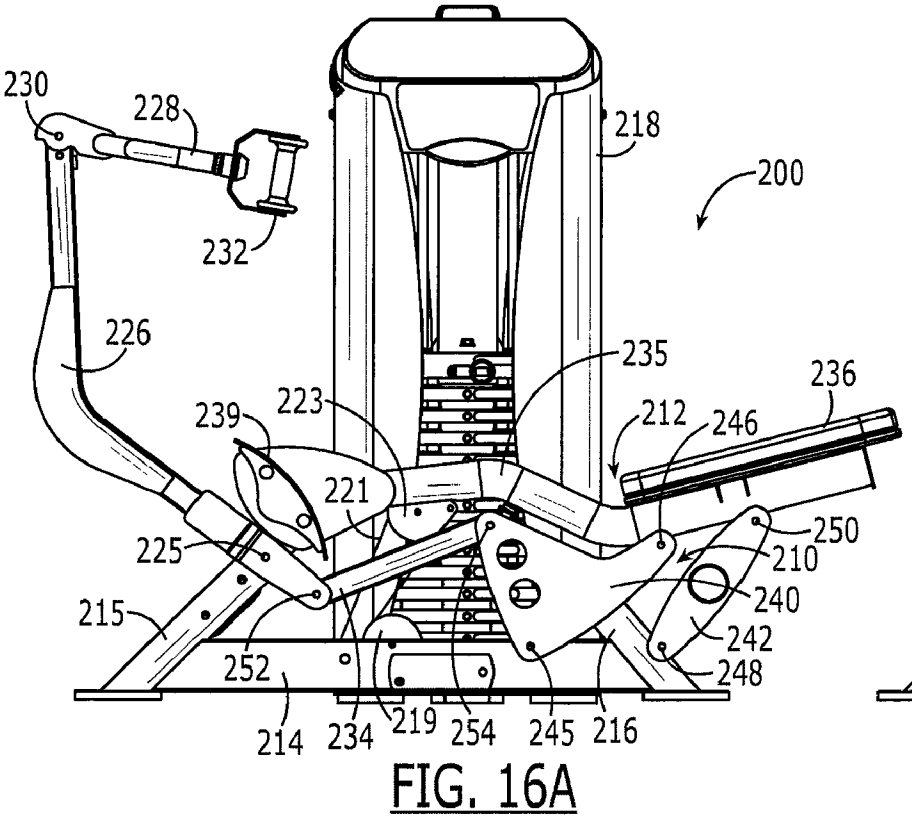
FIG. 16A is a side elevation view of a rowing exercise machine according to another embodiment, illustrating an exercise start position.
Figure 23:
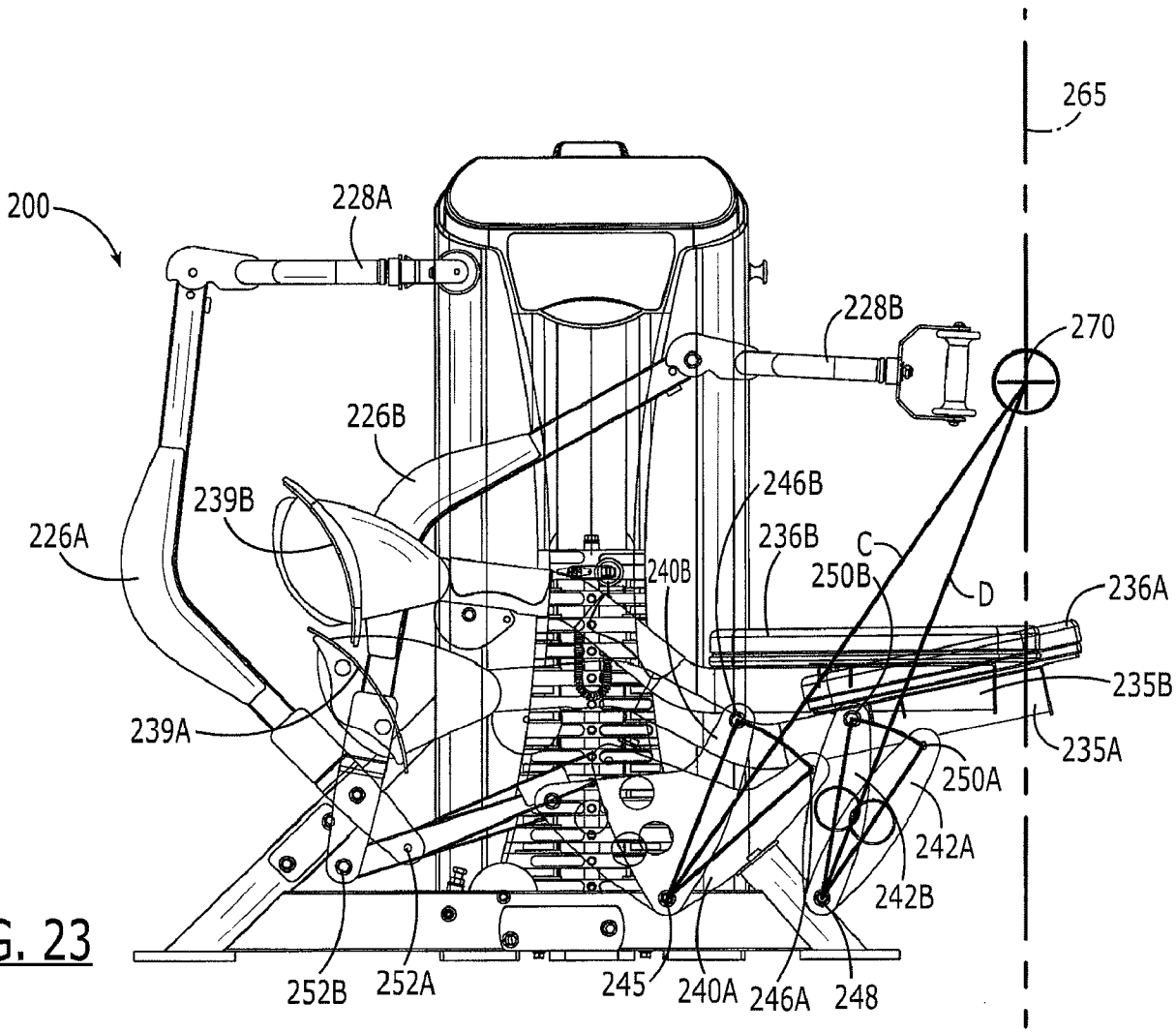
FIG. 23 is a side elevation view of the start and finish positions of the machine of FIGS. 16 to 22 superimposed, illustrating a theoretical pivot point for the four-bar user support pivot system.

FIG. 23 is a view which superimposes the start position of FIG. 16A with the finish position of FIG. 16B, with the parts which move indicated with an A after the reference number for the start position and a B after the reference number for the finish position. FIG. 23 shows the plotting of the theoretical pivot point 270 for the user support. It takes the overlapping composite view of the machine in the start and finish position and calculates the centerline C, D of the arcing movement for each link 240,242 of the user support pivot system. It then shows the point 270 in space where these two centerlines intersect, forming the theoretical pivot of the user support. From this point the gravitational centerline 265 through the theoretical pivot 270 can be determined, and is shown in FIG. 23 as a dotted vertical line. This illustrates that the four-bar pivot linkage system 210 could not be replaced by a single fixed pivot to create the same movement of a user support. A single fixed pivot would have to be placed at point 270 and would not work as it would intrude on the user and interfere with the user's ability to perform the exercise. Without the four-bar linkage, this unique movement pattern for the user support would not be possible.

This combined movement of seat and exercise arm provides a relatively safe and more natural feeling exercise motion. It replaces both the improper linear motion and the exaggerated arcing movement of some current rowing machines. By using the four-bar linkage as the user support pivot system, all the pivoting action can take place under the user and does not interfere with the performance of the exercise. While the pivot action is located below the seated user, the theoretical pivot is actually located in the user support area above the user support seat and would interfere with a seated user trying to perform the exercise if the four-bar linkage was replaced with a single pivot. Without the advantage of this four-bar pivot system combined with the connecting link, this combined exercise arm and user support movement would not be possible. The location of this theoretical pivot places a portion of user and user support on both sides of the pivots gravitational centerline throughout the exercise motion. By having a small portion of the user's body weight (as well as the weight of the user support) on the opposite side of the gravitational centerline from the resistance it helps to counter-balance or lessen the initial lift (starting resistance).

Figure 24A:
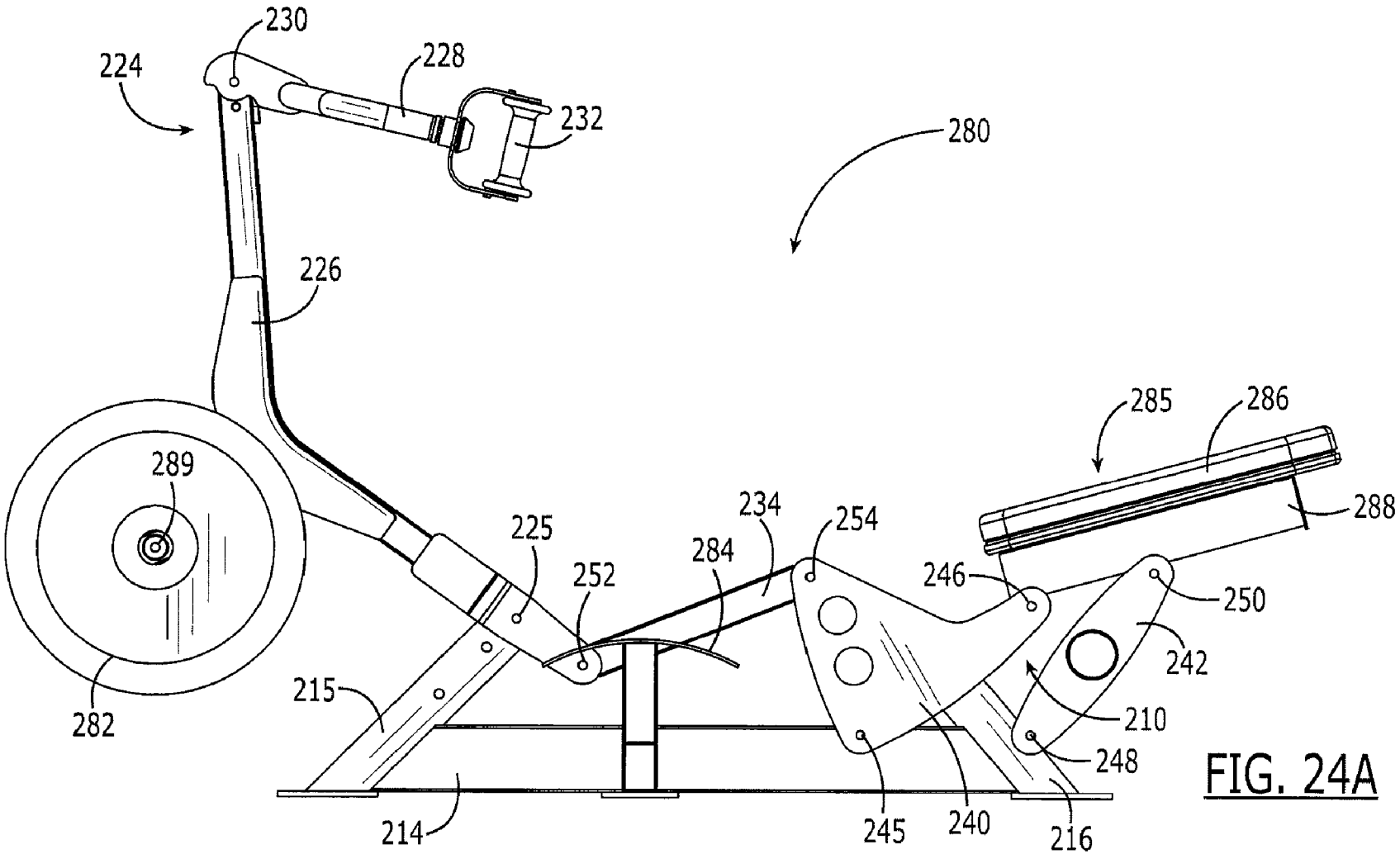
FIG. 24A is a side elevation view of the start position of another embodiment of a rowing machine.
Figure 24B:
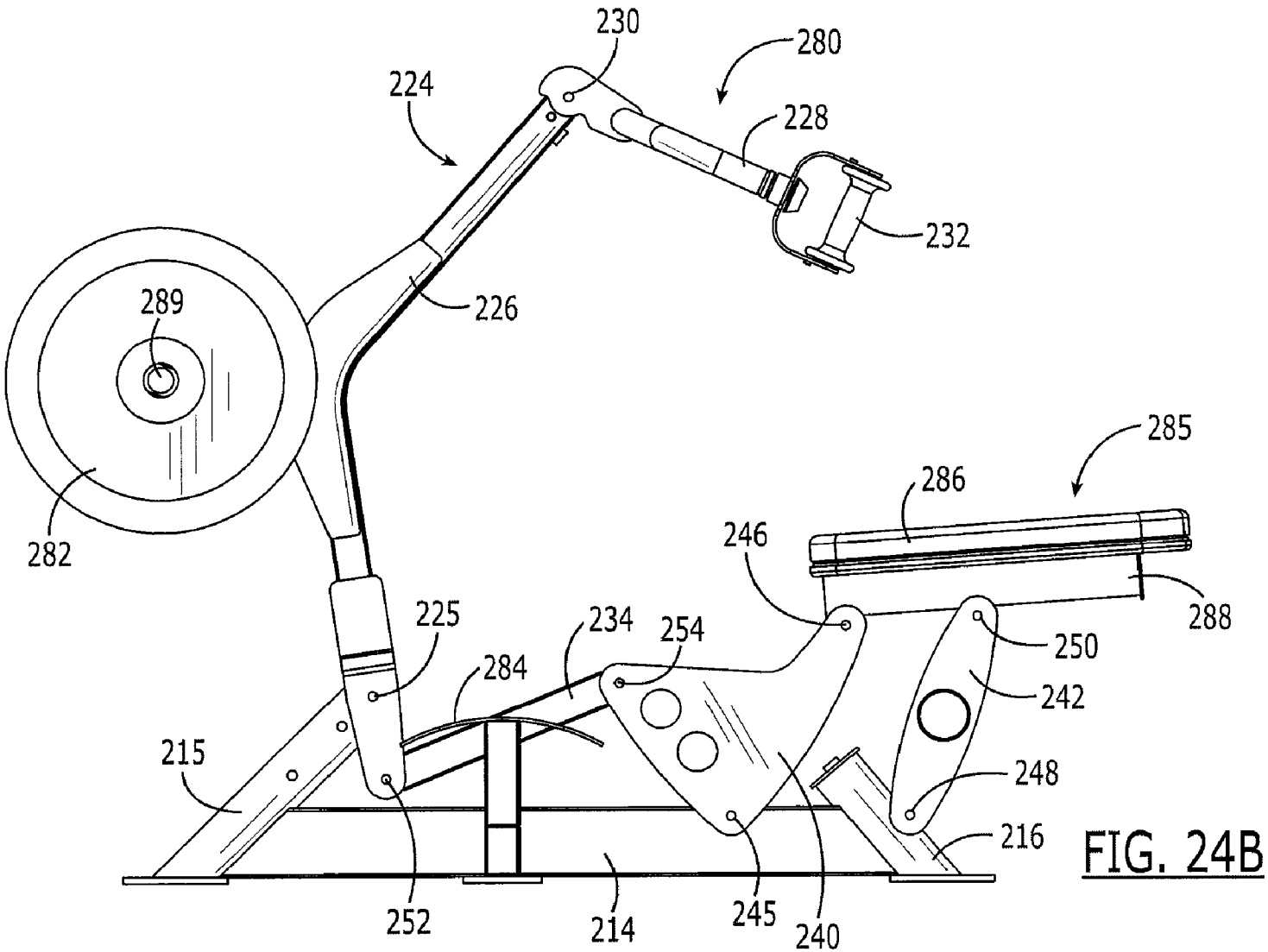
FIG. 24B is a side elevation view similar to FIG. 24A illustrating a finish position of the rowing machine.

FIGS. 24A and 24B illustrate the start and finish positions for a rowing exercise machine 280 according to another embodiment. The machine of FIGS. 24A and 24B is similar to the rowing machine of FIGS. 16 to 23, and like reference numbers have been used for like parts as appropriate. In the previous embodiment, the load or exercise resistance is supplied by the weight stack via a cable and pulley linkage. In this embodiment, the weight stack and cable and pulley linkage are replaced with hand loaded weight plates 282. The weight plates 282 are mounted on receiving pegs 289 attached to the exercise arm at a location between its pivotal connection to the handle assembly 228 and the forward frame upright 215.

The foot rest arrangement in FIGS. 24A and 24B is similar to that of the embodiment of FIGS. 13A and 13B, with the foot rests 284 stationary and mounted on the base section 214 of the main frame rather than on the user support. In this embodiment, the user support 285 is smaller than in the previous embodiment, and has a seat pad 286 supported on user support base or frame 288 which does not extend beyond the forward end of pad 286.

The rowing machine 280 functions in substantially the same manner to that of the previous embodiment. The start position of FIG. 24A has the user support in an inclined position similar to that of FIGS. 16A and 17A, and a user on the machine is in substantially the same forwardly tilted position as in FIG. 17A, apart from the fact that their feet are resting on the fixed foot rests 284 instead of forward foot rests 239 of the previous embodiment which move with the user support. The end position of the user's torso, hands and arms is substantially the same as in FIG. 17B, but their feet remain in the same position on fixed foot rests 284, unlike the foot position of FIG. 17B. This embodiment provides an equivalent combined exercise arm and user support movement to the previous embodiment, so that a user performing a rowing exercise mimics the natural rearward arc a person's upper body goes through when rowing.

Figure 25A:
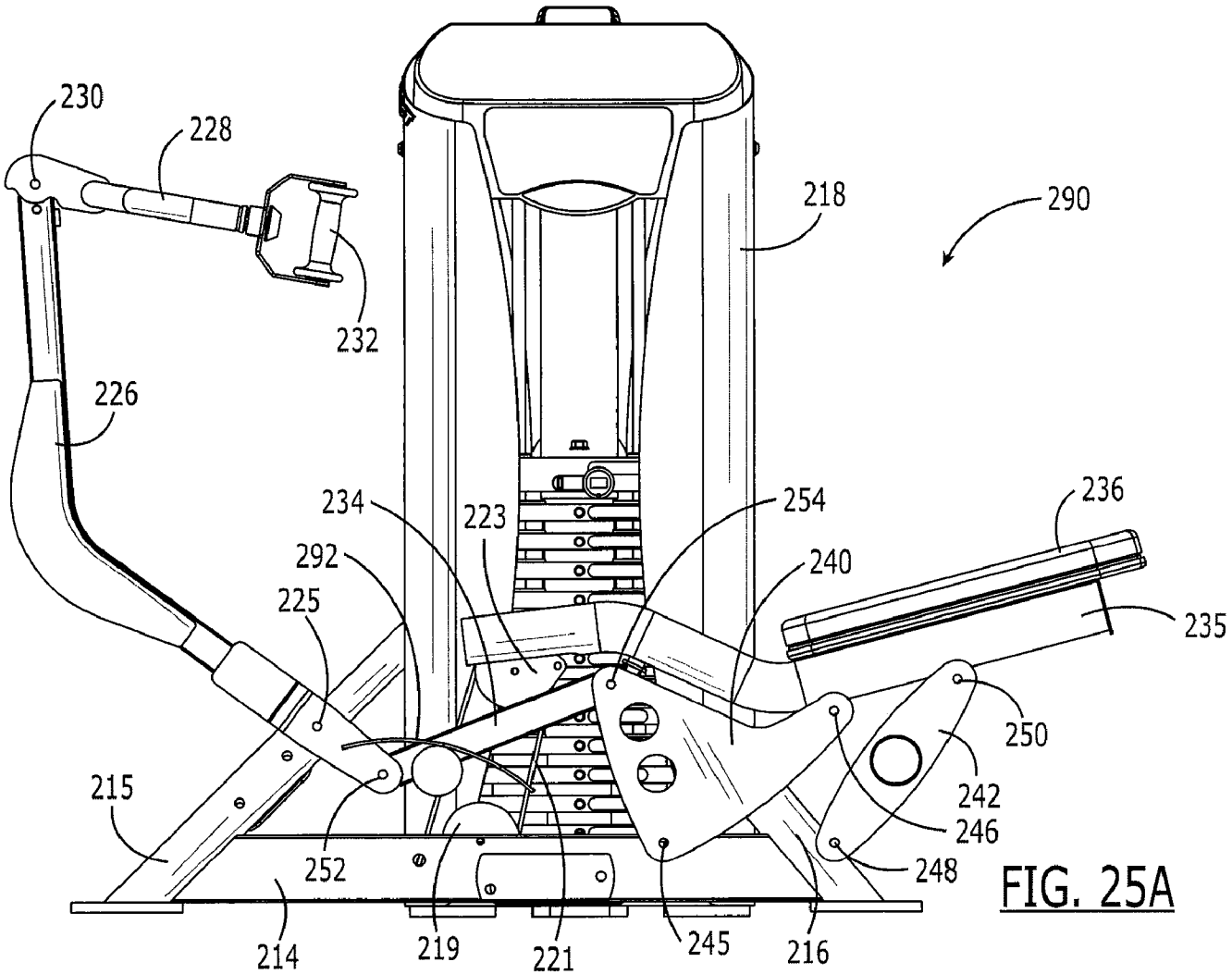
FIG. 25A is a side elevation view of a modified rowing exercise machine illustrating the start position of a rowing exercise.
Figure 25B:
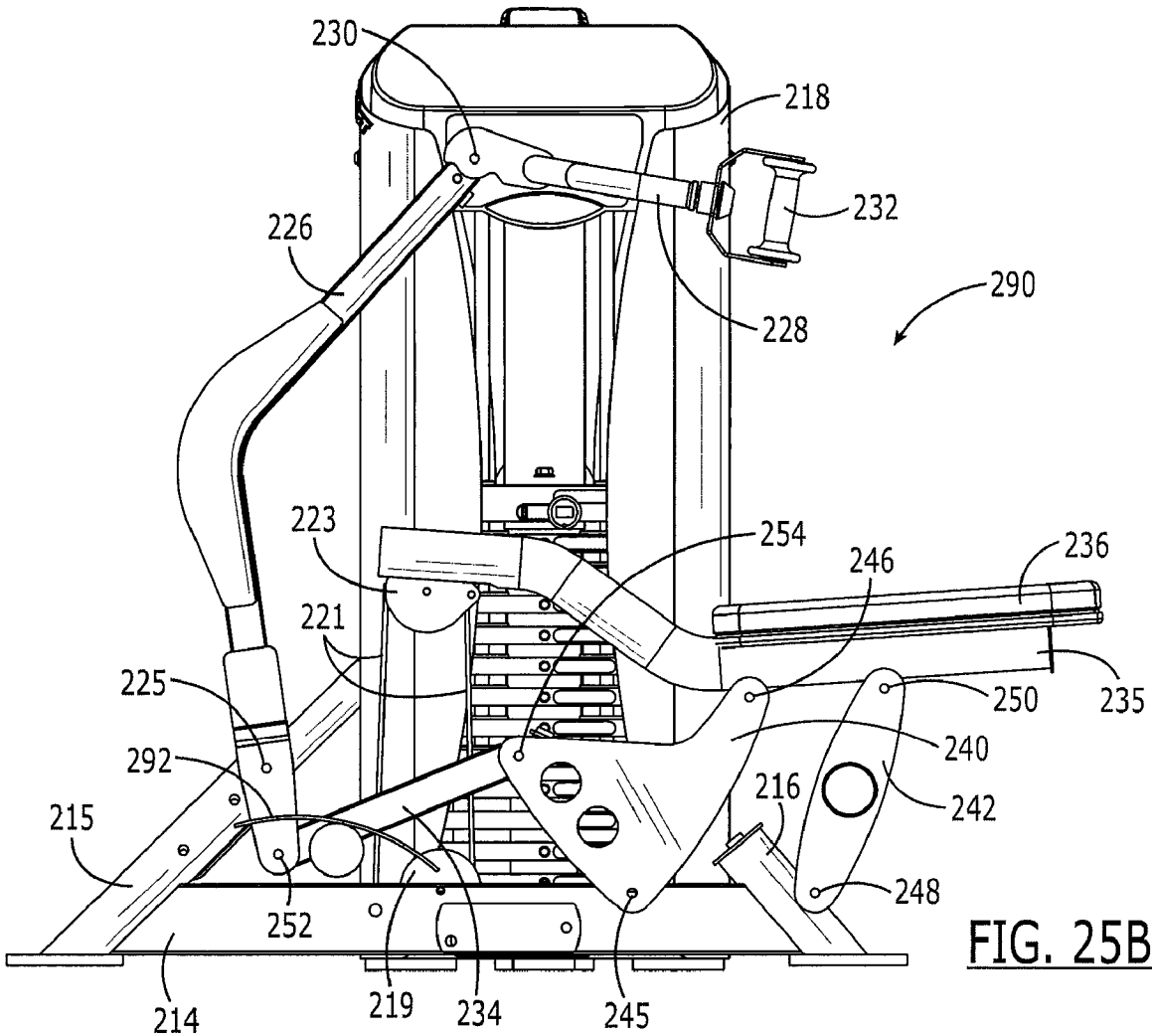
FIG. 25B is a side elevation view similar to FIG. 25A illustrating the finish position of a rowing exercise.

FIGS. 25A and 25B illustrate the start and finish positions of a rowing exercise machine 290 in a third embodiment. This version is similar to that of FIGS. 16 to 23, and like reference numbers have been used for like parts as appropriate. The main difference is that the foot rests 292 in this machine are mounted on the connecting link 234 instead of the user support frame 235. In the first embodiment the foot rests 239 traveled in a fixed position relative to the user support seat. In this embodiment, the foot rests 292 still travel in relationship to the user support seat 236 between the start position of FIG. 25A and the finish position of FIG. 25B. However, the foot rests are not in fixed relationship with the user support in this embodiment, since they are mounted on a different moving part of the machine. Operation of the rowing exercise machine 290 is substantially identical to that of the exercise machine of FIGS. 14 to 21, and reference may be made to the description of that machine for an understanding of how a rowing exercise is performed on machine 290. The only difference is the movement of the user's feet, which are in a more horizontal position in this machine.

Figure 26A:
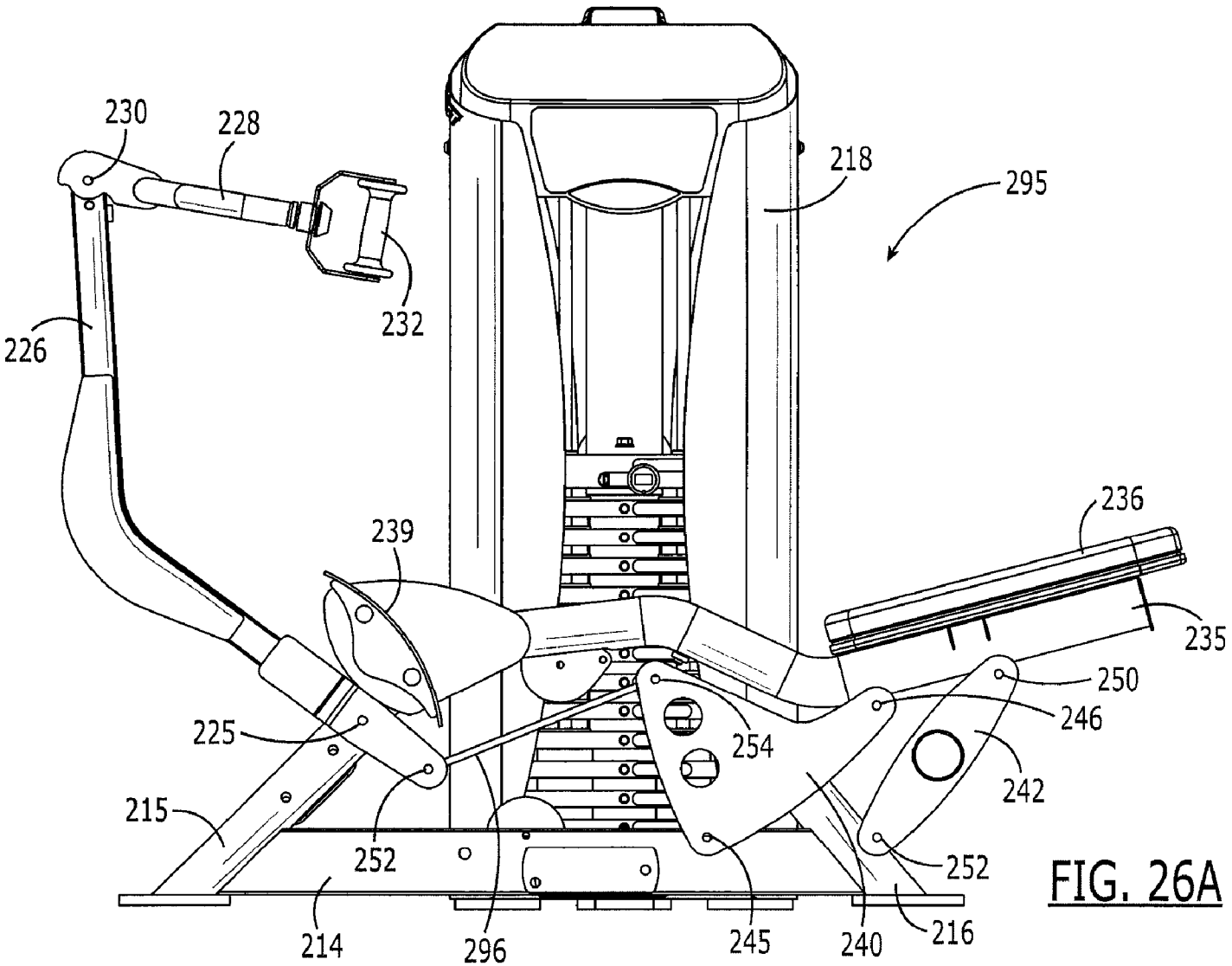
FIG. 26A is a side elevation view of another embodiment of a rowing exercise machine, illustrating the start position of a rowing exercise.
Figure 26B:
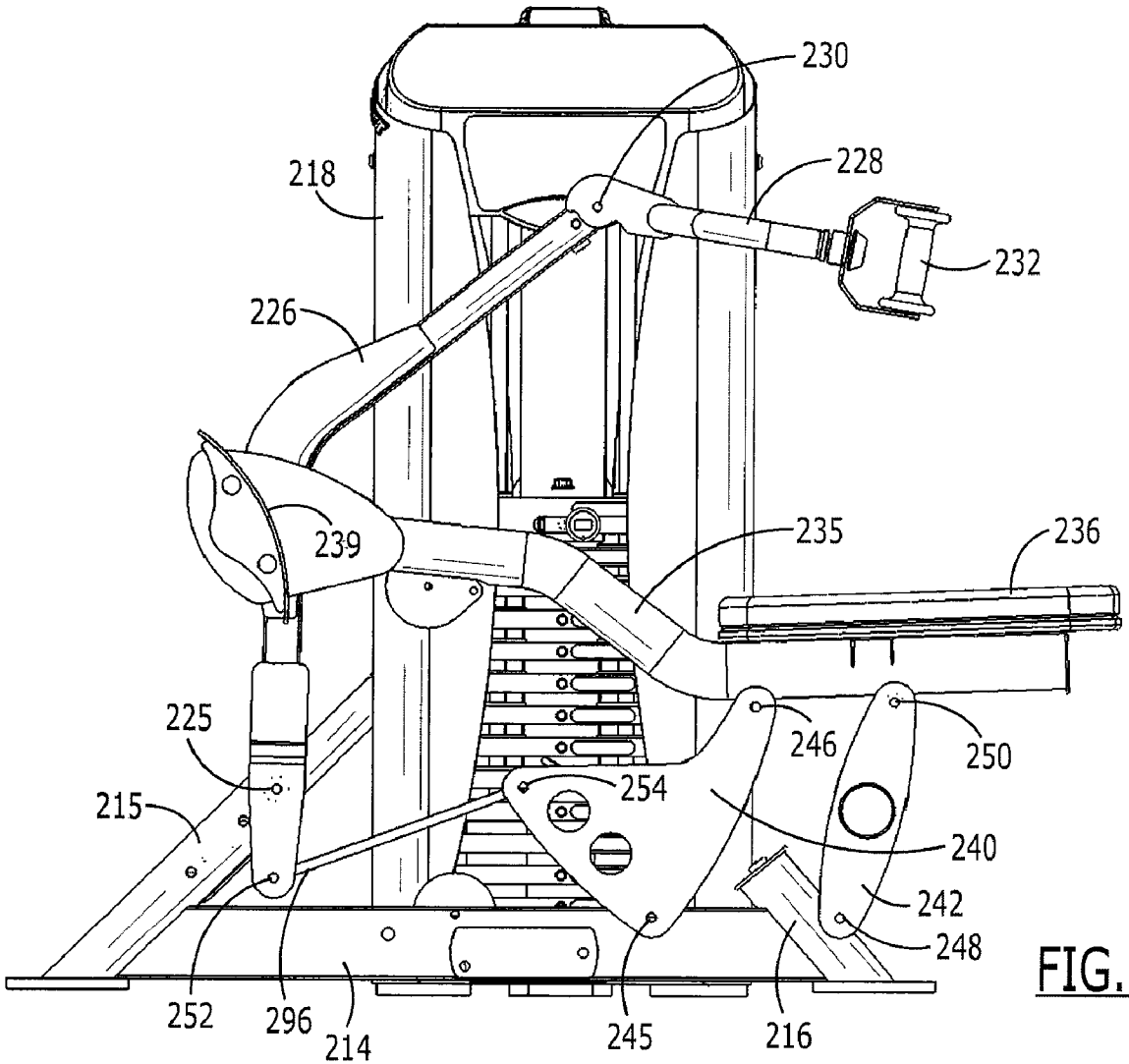
FIG. 26B is a side elevation view similar to FIG. 26A illustrating the finish position of a rowing exercise.

FIGS. 26A and 26B illustrate a rowing exercise machine 295 of another embodiment. This is the same as the embodiment of FIGS. 14 to 21 except that solid connecting link 234 has been replaced by a cable or flexible line 296 which is connected to articulating connectors 252, 254 at the end of arm 226 and the pivoting link 240 at its opposite ends. All other parts are identical to those of FIGS. 14 to 21 and like reference numbers have been used for like parts as appropriate. The machine 295 functions in exactly the same way as machine 200 of FIGS. 14 to 21, pulling the user support pivot system 210 and causing it to rotate when the exercise arm 226 is pulled rearward and downward by the user.

In each of the rowing exercise machines of FIGS. 16 to 26, the exercise starts with the user in a seated position, knees slightly bent, upper torso in a slight forward lean, shoulders in a forward roll and their arms extended forward. The exercise movement finishes with the user's torso in a slight recline, arms bent with their elbows at their sides and their hands in front of their abdomen. The rowing exercise machines of FIGS. 16 to 26 produce a natural and comfortable rowing action while exercising the lat muscles of the upper back.

In all of the above machines, both pulldown and rowing machines, a four-bar linkage user support pivot system is used. This allows the user's body motion to be controlled to follow a path which is close to that of a natural chin up or a natural rowing motion, which would not be possible with a single pivot mount. All of the machines have a user engagement device or exercise arm with a linkage linking movement of the exercise arm to movement of the user support. A load provides resistance to movement of the user support or the exercise arm. Additionally, each design has a primary user support or seat, as well as at least one secondary user support for the feet or another part of the user's body, the secondary support being mounted on the user support in some embodiments, or on the connecting link or fixed on the frame in other embodiments. Some embodiments have two secondary user supports, for example for the user's feet and the user's thighs, particularly the lat pulldown machines.

The machines are configured to produce starting and finishing arm/hand positions for the user similar to those encountered in the corresponding free weight exercise, because the user support adjusts to the exercise arm position and does not force the user's hands to travel in an exaggerated arc that is greater than that of the natural exercise motion or in linear exercise paths without the slight natural arc that allows them to replicate the movement when rowing a boat or performing a chin up. In each case, the exercise arms travel separate from the user support, however the movement of the user support is dependent on and linked to the movement of the exercise arm. Although movement of the exercise arm in the above embodiments is rotational, it may be linear instead of rotational, as taught in co-pending application Ser. Nos. 10/633,805 and 10/699,995 referenced above, and still produce the same movement pattern to the user support.

This unique exercise motion is possible because of the four-bar user support pivoting system with a theoretical pivot which is in an inaccessible location, such as above the user support. Each of the above embodiments takes the movement of a single point pivot that would normally be located in a position that would interfere with the user performing the exercise, or beneath the machine base in the case of FIGS. 14 and 15, and places the pivotal linkage out of the way under the user positioned on the moving user support. Because a small portion of the user's body weight (as well as the weight of the user support) is on the opposite side of the gravitational centerline from the resistance, it helps to counter-balance or lessen the initial lift (starting resistance). With the combined movement to the user and user support, there is no perceived shift in the combined weight from one side of the gravitational centerline to the other and no noticeable affect on the exercise resistance felt by the user. Without the forward shift, the user could feel a slight drop-off in resistance at the end of the exercise as their upper torso leans rearward and shifts to the non-resistance side of the gravitational centerline.

It should be understood that all the different elements used in the various embodiments above may be mixed and interchanged while still achieving the desired exercise movement. The footrest in any embodiment could be stationary or move in relationship to the user support seat; the thigh hold down in the pulldown machines could be fixed or adjustable and that adjustment could vary in form as taught in pending application Ser. No. 10/699,995 referenced above. Exercise arms may be one piece (dependent) or two piece (independent) as taught in application Ser. No. 10/699,995, and may be rigid or flexible. The connecting links could be made adjustable; the connecting link could connect the exercise arm to either of the other two moving parts, i.e. the user support or the four-bar pivot linkage; and different handles could be used without affecting the function of any of the above embodiments. Other types of connecting link could be used, such as a multi-part connecting link or flexible cable link as in some of the above embodiments. The cable and pulley system linked to a weight stack in some of the above embodiments could be interchanged with weight plates mounted on pegs. Any of the various designs could have the resistance associated with any of the moving parts (user support, exercise arm or connecting link).

Although the embodiments of FIGS. 16 to 26 are configured as mid row exercise machines, they may alternatively be configured for performing different types of lat row exercise such as low row and leverage row, by suitable arrangement of the exercise arm to place the handles in the appropriate position for the start of such exercises.

It should also be noted that others skilled in the art could use different types and forms of components without affecting the scope of this invention. Cables could be replaced with belts, ropes, chains or the like, pulleys replaced with sprockets; the seat and foot rest could be made adjustable. Other types of resistance known to the art could by used in place of the weight stack or weight plates of the above embodiments, such as hydraulic, pneumatic, electro-magnetic or elastic band resistance devices.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A lat exercise machine for exercising the latissimus dorsi ("lat") muscles of the back, comprising:

a main frame having a front end and a rear end;

a user support pivot mount;

a user support which is adapted to support a user in an exercise ready position when performing a lat exercise, the user support being pivotally mounted on the user support pivot mount for pivotal movement relative to the main frame in a predetermined pivotal movement path about a user support pivot axis from an exercise start position during performance of a lat exercise by a user supported on the user support;

the user support pivot mount comprising a four bar pivot linkage between the user support and main frame, the four bar pivot linkage defining the location of the user support pivot axis whereby a gravitational center line extending vertically through the user support pivot axis extends through a user engaging part of the user support during at least part of the pivotal movement of the user support along said predetermined pivotal movement path;

one exercise actuating user engagement device movably mounted relative to the main frame and having at least one handle gripped and actuated by a user positioned on the user support in order to perform the exercise;

a connecting linkage which links movement of the user engagement device to movement of the user support whereby the combined movement of the user engagement device and user support defines a lat exercise; and a load which resists movement of at least one of the user support, user engagement device, and connecting linkage;

whereby the user performs a lat exercise on the machine by actuating said one user engagement device only.

2. The machine of claim 1, wherein the user support pivot axis defined by the four bar pivot linkage is located above the user support in the vicinity of a user positioned on the user support during an exercise movement.

3. A lat exercise machine for exercising the latissimus dorsi ("lat") muscles of the back, comprising:

a main frame having a front end and a rear end;

a user support pivotally mounted relative to the main frame to support a user in an exercise position and moving in a predetermined path about a user support pivot axis from a start position during an exercise movement;

a user support pivot mount comprising a four bar pivot linkage between the user support and main frame, the four bar pivot linkage defining the user support pivot axis of the user support pivotal movement between the start and end position;

at least one user engagement device movably mounted relative to the main frame and having at least one handle for gripping by a user positioned on the user support, the user engagement device being adapted to move during a lat exercise from a first position which corresponds to the user support start position to a selected second position at the end of the lat exercise;

a connecting linkage which links movement of the user engagement device to movement of the user support whereby movement of the user engagement device from the first position to the second position simultaneously pivots the user support in said predetermined path from the start position, and the combined movement of the user engagement device and user support defines a lat exercise;

a load which resists movement of at least one of the user support, user engagement device, and connecting linkage; and the user support having a primary support portion which is adapted to support a first part of a user's body and a secondary support portion spaced from the primary support portion and adapted to support a second part of a user's body throughout an exercise movement, the primary support portion supporting the majority of a user's weight at least in the start position of the user support, and the secondary support portion being fixed at a predetermined angular orientation relative to the primary portion during the exercise movement, whereby the primary and secondary portions move together at the same fixed angular orientation to one another throughout the exercise movement.

4. The machine of claim 3, wherein the primary support portion comprises a seat pad.

5. The machine of claim 4, wherein the seat pad is inclined in the start position and rotates towards a substantially horizontal orientation as the user support moves in said predetermined path about the user support pivot axis during an exercise.

6. The machine of claim 5, wherein the seat pad moves in a forward direction from the user support start position along said predetermined path during an exercise.

7. A lat exercise machine for exercising the latissimus dorsi ("lat") muscles of the back, comprising:

a main frame having a front end and a rear end;

a user support pivotally mounted relative to the main frame to support a user in an exercise position and moving in a predetermined path about a user support pivot axis from a start position during an exercise, the user support comprising a seat pad which supports a user in a seated position and a foot rest which supports the feet of a user, the foot rest being secured at a fixed angular orientation relative to the seat pad and not moving relative to the seat pad as the user support travels along the predetermined path during the exercise;

a user support pivot mount comprising a four bar pivot linkage between the user support and main frame, the four bar pivot linkage defining the user support pivot axis and controlling the user support pivotal movement along said predetermined path between the start and end position;

at least one user engagement device movably mounted relative to the main frame and having at least one handle for gripping by a user positioned on the user support;

a connecting linkage which links movement of the user engagement device to movement of the user support whereby the combined movement of the user engagement device and user support defines a lat exercise; and a load which resists movement of at least one of the user support, user engagement device, and connecting linkage.

8. The machine of claim 4, wherein the secondary support portion comprises a thigh hold down device for engaging the thighs of a user seated on the seat pad.

9. A lat exercise machine for exercising the latissimus dorsi ("lat") muscles of the back, comprising:

a main frame having a front end and a rear end;

a user support pivot mount;

a user support pivotally mounted on said user support pivot mount for pivotal movement relative to the main frame about a user support pivot axis defined by said user support pivot mount, the user support being adapted to support a user in an exercise position and moving along a predetermined pivotal movement path about said user support pivot axis from a start position during an exercise;

the user support pivot mount comprising a four bar pivot linkage between the user support and main frame;

at least one user engagement device separate from the user support having at least one arm portion which is movably mounted relative to the main frame and at least one handle on the arm portion for gripping by a user positioned on the user support;

a connecting linkage which links movement of the user engagement device to movement of the user support whereby the combined movement of the user engagement device and user support defines a lat exercise;

a load which resists movement of at least one of the user support, user engagement device, and connecting linkage; and the user support comprising a seat pad which supports a user in a seated position, and a foot rest for supporting the feet of a seated user that is mounted on a different part of the machine from both the seat pad and the entire user engagement device including any portion of the user engagement device which moves in response to actuation by the user when performing an exercise.

10. The machine of claim 9, wherein the main frame has a base portion and the foot rest is a stationary foot rest mounted on the base portion in front of the seat.

11. The machine of claim 9, wherein the foot rest is mounted on the connecting linkage and travels with the connecting linkage during the exercise movement.

12. The machine of claim 1, wherein the four bar pivot linkage comprises a first pivot link pivotally connected to the main frame at a first position for rotation about a first pivot axis and pivotally connected to the user support at a second position for rotation about a second pivot axis, and a second pivot link pivotally connected to the main frame at a location spaced forward from the first pivot axis for rotation about a third pivot axis, and pivotally connected to the user support at a location spaced forward from the second pivot axis for rotation about a fourth pivot axis, said first, second, third and fourth pivot axes together defining the user support pivot axis about which said user support rotates during an exercise.

13. The machine of claim 12, wherein the main frame has a base portion and both pivot links are pivotally connected to the base portion for rotation about the first and third pivot axes, respectively, the user support has a rest position which defines the start position of the user support during performance of a lat exercise, the second pivot axis being located rear of the first pivot axis and the fourth pivot axis being located rear of the third pivot axis in the rest position of the user support and during movement of the user support in said pivotal movement path during an exercise.

14. The machine of claim 12, wherein the connecting linkage extends between a first location on the user engagement device and a second location on the second pivot link which is spaced between the third and fourth pivot axes.

15. The machine of claim 14, wherein the second pivot link comprises at least one link plate of generally triangular shape, the third and fourth pivot axes being located in the vicinity of two apices of the triangular shape, and the second location on the second pivot link being located in the vicinity of the third apex of the triangular shape.

16. The machine of claim 12, wherein the user support has a base and a seat pad is mounted on the base to support a seated user during an exercise, and the second and fourth pivot axes are located generally under the seat pad.

17. The machine of claim 16, wherein the seat pad has a forward end, the fourth pivot axis being associated with user support base in the vicinity of the forward end of the seat pad, and the second pivot axis being associated with the user support base and located beneath the seat pad and rearward of the fourth pivot axis.

18. A lat exercise machine for exercising the latissimus dorsi ("lat") muscles of the back, comprising:

a main frame having a front end and a rear end;

a user support pivotally mounted relative to the main frame and adapted to support a user in an exercise position;

a user support pivot mount comprising a four bar pivot linkage between the user support and main frame, the four bar pivot linkage controlling pivotal movement of the user support in a predetermined path about a user support pivot axis from an exercise start position during an exercise;

at least one user engagement device movably mounted relative to the main frame and having at least one handle for gripping by a user positioned on the user support;

a connecting linkage which links movement of the user engagement device to movement of the user support whereby the combined movement of the user engagement device and user support defines a lat exercise;

a load which resists movement of at least one of the user support, user engagement device, and connecting linkage; and the user engagement device comprising an exercise arm pivoted to the main frame at a location forward and upward from the user support for rotation about an exercise arm pivot axis at a higher elevation than the user support in all positions of the user support along said predetermined path, and having a first arm portion extending generally upward from the exercise arm pivot axis and a handle on the first arm portion which extends away from the first arm portion towards the user support.

19. A lat exercise machine for exercising the latissimus dorsi ("lat") muscles of the back, comprising:

a main frame having a front end and a rear end;

a user support pivot mount;

a user support pivotally mounted on said user support pivot mount for pivotal movement relative to the main frame about a user support pivot axis defined by said user support pivot mount, the user support being adapted to support a user in an exercise position and moving along a predetermined pivotal movement path about said user support pivot axis from a start position during an exercise;

the user support pivot mount comprising a four bar pivot linkage between the user support and main frame;

at least one user engagement device movably mounted relative to the main frame and having at least one handle for gripping by a user positioned on the user support, the handle being located in a first position relative to the user support when the user support is located in the start position;

a connecting linkage which links movement of the user engagement device to movement of the user support whereby movement of the handle of the user engagement device from the first position simultaneously rotates the user support from the start position along the predetermined pivotal movement path and the combined movement of the user engagement device and user support defines a lat exercise;

a load which resists movement of at least one of the user support, user engagement device, and connecting linkage; and the user engagement device comprising an exercise arm pivoted to the main frame at a location forward from the user support for rotation about an exercise arm pivot axis, and having a first arm portion extending rearwards from the exercise arm pivot axis and over the user support with the handle suspended from the first arm portion above the user support at a predetermined position adapted to allow the handle to be gripped by at least one hand of a user positioned on the user support in an exercise start position with their arms extended upward in a start position for a lat pulldown exercise.

20. The machine of claim 18, wherein the handle extends from the first exercise arm portion for gripping by at least one hand of a user positioned on the user support with their arms extended in the start position for a lat exercise.

21. The machine of claim 18, wherein the connecting link is pivotally connected between the exercise arm and the user support.

22. The machine of claim 21, wherein the exercise arm has a second arm portion extending forward from the exercise arm pivot axis, and the connecting linkage is pivotally connected between the second end portion of the exercise arm and the user support.

23. The machine of claim 18, wherein the connecting linkage is pivotally connected between the exercise arm and the four bar linkage.

24. The machine of claim 1, wherein the connecting linkage is an elongate flexible member.

* * * * *